US006704537B2

(12) United States Patent
Takeuchi et al.

(10) Patent No.: US 6,704,537 B2
(45) Date of Patent: Mar. 9, 2004

(54) INDUCTION HEATING TYPE IMAGE HEATING APPARATUS

(75) Inventors: Akihiko Takeuchi, Susono (JP); Masahiro Suzuki, Numazu (JP); Tomonori Shida, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/352,041

(22) Filed: Jan. 28, 2003

(65) Prior Publication Data

US 2003/0152405 A1 Aug. 14, 2003

(30) Foreign Application Priority Data

Jan. 31, 2002 (JP) ..... 2002/023000

(51) Int. Cl.[7] ..... G03G 15/20

(52) U.S. Cl. ..... 399/328; 219/216; 219/619; 399/330

(58) Field of Search ..... 399/328, 327, 399/330; 219/216, 619, 675; 432/60

(56) References Cited

U.S. PATENT DOCUMENTS

| | | | | |
|---|---|---|---|---|
| 5,179,397 | A | 1/1993 | Ohzeki et al. | 346/160 |
| 5,223,900 | A | 6/1993 | Yuminamochi et al. | 355/273 |
| 5,331,385 | A | 7/1994 | Ohtsuka et al. | 355/290 |
| 5,543,904 | A | 8/1996 | Kato et al. | 355/285 |
| 5,552,582 | A | 9/1996 | Abe et al. | 219/619 |
| 6,088,567 | A | 7/2000 | Miyashiro et al. | 399/400 |
| 6,097,919 | A | 8/2000 | Takeuchi et al. | 399/298 |
| 6,263,172 | B1 | 7/2001 | Suzuki et al. | 399/67 |
| 6,298,215 | B1 | 10/2001 | Nomura et al. | 399/328 |
| 6,347,211 | B2 | 2/2002 | Nanataki et al. | 399/328 |
| 6,456,819 | B1 | 9/2002 | Abe et al. | 399/329 |

FOREIGN PATENT DOCUMENTS

| | | |
|---|---|---|
| JP | 51-109739 | 9/1976 |
| JP | 8-16005 | 1/1996 |
| JP | 9-305043 | 11/1999 |
| JP | 2000-162912 | 6/2000 |
| JP | 2000-181258 | 6/2000 |
| JP | 2000-243545 | 9/2000 |
| JP | 2001-66933 | 3/2001 |
| JP | 2001-230065 A * | 8/2001 |

* cited by examiner

*Primary Examiner*—Joan Pendegrass
(74) *Attorney, Agent, or Firm*—Fitzpatrick, Cella, Harper & Scinto

(57) ABSTRACT

An image heating apparatus for heating an image formed on a recording material includes a heating member having a heat-generating layer, and magnetic field-generating means for generating a magnetic field to induce an eddy current in the heat-generating layer. The magnetic field-generating means includes a core and a coil disposed around the core in a longitudinal direction of the core. When the coil has a minimum length L1 and a maximum length L2 respectively in a longitudinal direction thereof; the core has a maximum length Lc in the longitudinal direction thereof; the core and the heating layer form a gap d therebetween; and the recording material has a prescribed maximum size giving a passing width Lp; these values satisfying the following relationship:

$$Lp+2(2d+1) \leq Lc \leq L1 < L2.$$

8 Claims, 18 Drawing Sheets

INDUCTION HEATING TYPE IMAGE HEATING APPARATUS

FIELD OF THE INVENTION AND RELATED ART

The present invention relates to an image heating apparatus such as a thermal fixing device mounted in an image forming apparatus such as a copying machine, a printer, or the like. In particular, it relates to an image heating apparatus utilizing an induction heating principle.

An image heating apparatus such as a thermal fixing device makes up a large proportion of energy consumption in an entire image forming apparatus, so that the image heating apparatus is desired to reduce its power consumption. Further, there is also a large demand for a reduction in waiting time for printing.

As an image heating apparatus meeting such demands, an induction heating type image heating apparatus has attracted attention (e.g., Japanese Laid-Open Utility Model Application No. Sho-51-109739).

FIG. 16 shows the general structure of an example of an electromagnetic induction heating type fixing apparatus.

In the drawing, a reference numeral 10 designates a fixing film (which hereinafter will be referred to as a sleeve) comprising an electromagnetic induction type heat generating layer (electrically conductive layer, magnetic layer, electrically resistive layer). The fixing film 10 is cylindrical and flexible, and is used as a rotational heating member.

A reference numeral 16*c* designates a film guiding member (which hereinafter will be referred to as sleeve guiding member) in the form of a trough, which is approximately semicircular in cross section. The sleeve 10 is loosely fitted around the sleeve guiding member 16*c*.

A reference numeral 15 designates a magnetic field (flux) generating means disposed within the sleeve guiding member 16*c*. The magnetic field generating means comprises an exciting coil 18, and a magnetic core 17 having an T-shaped cross section.

Designated by a reference numeral 30 is an elastic pressure roller, which is kept pressed upon the bottom surface of the sleeve guiding member 16*c*, with the interposition of the sleeve 10, with the application of a predetermined pressure, forming a fixing nip N having a predetermined width.

The magnetic core 17 of the magnetic field generating means 15 is disposed so that its position corresponds to the position of the fixing nip N.

The pressure roller 30 is rotationally driven by a driving means M, in the counterclockwise direction indicated by an arrow in the drawing. As the pressure roller 30 is rotationally driven, friction occurs between the peripheral surface of the pressure roller and the outwardly facing surface of the sleeve 10, in the fixing nip N. As a result, the sleeve 10 is rotated by the pressure roller 30, around the sleeve guiding member 16*c*, in the clockwise direction indicated by an arrow in the drawing, at a peripheral velocity substantially equal to the peripheral velocity of the pressure roller 30, with the inwardly facing surface of the sleeve 10 sliding on the bottom surface of the sleeve guiding member 16*c*, in the fixing nip N (pressure roller-driving method).

The sleeve guiding member 16*c* plays the role of maintaining the fixing pressure in the fixing nip N, the role of supporting the magnetic field generating means 15 comprising the combination of the exciting coil and magnetic core 17, the role of supporting the sleeve 10, and the role of keeping the sleeve 10 stable while the sleeve 10 is rotationally driven. The sleeve guiding member 16*c* is formed of such a material that does not prevent the passage of a magnetic flux through the sleeve guiding member 16*c* and that can withstand a large amount of load.

The exciting coil 18 generates an alternating magnetic flux as alternating current is supplied to the exciting coil 18 from an unshown exciting circuit. The alternating magnetic flux generated by the exciting coil 18 is concentrated to the fixing nip N, by the magnetic coil 17 with the T-shaped cross section disposed so that its position corresponds to that of the fixing nip N. The magnetic flux concentrated to the fixing nip N generates eddy current in the electromagnetic induction type heat generating layer of the sleeve 10. This eddy current and the specific resistance of the electromagnetic induction type heat generating layer generates heat (Joule heat) in the electromagnetic induction type heat generating layer. With the presence of the magnetic core 17 with the T-shaped cross section which concentrates the alternating magnetic field to the fixing nip N, the electromagnetic induction heat generation is concentrated to the portion of the sleeve 10 within the fixing nip N. Therefore, the fixing nip N is highly efficiently heated.

The temperature of the fixing nip N is kept at a predetermined level by a temperature control system, inclusive of an unshown temperature detecting means, which controls the current supply to the exciting coil 18.

Thus, as the pressure roller 30 is rotationally driven, the sleeve 10 is rotated around the sleeve guiding member 16, while current is supplied to the exciting coil 18 from the exciting circuit. As a result, heat is generated in the sleeve 10 through electromagnetic induction, increasing the temperature of the fixing nip N to a predetermined level, at which it is kept. In this state, a recording medium P, on which an unfixed toner image t has been formed, is conveyed to the fixing nip N, or the interface between the sleeve 10 and pressure roller 30, with the image bearing surface of the recording medium P facing upward, in other words, facing the surface of the fixing sleeve. In the fixing nip N, the recording medium P is conveyed with the sleeve 10, being sandwiched between the sleeve 10 and pressure roller 30, the image bearing surface of the recording medium P remaining flatly in contact with the outwardly facing surface of the sleeve 10. While the recording medium P is conveyed through the fixing nip N, the recording medium P and the unfixed toner image t thereon are heated by the heat generated in the sleeve 10 by electromagnetic induction. As a result, the unfixed toner image t is permanently fixed to the recording medium P. After being passed through the fixing nip N, the recording medium P is separated from the peripheral surface of the rotating sleeve 10, and then, is conveyed further to be discharged from the image forming apparatus.

Incidentally, as described above, the exciting oil 18 is required to approach the fixing sleeve 10. More specifically, as shown in FIG. 17, the exciting coil is, e.g., wound substantially in a planar shape and then transformed into a boat shape by bending it in a direction of arrows in the drawing (e.g., Japanese Laid-Open Patent Application (JP-A) No. 2000-243545).

A dimensional relationship in a longitudinal direction among the thus-prepared coil 18, the magnetic core 17, the sleeve 10, and the recording medium P is shown in FIG. 18.

Referring to FIG. 18, the magnetic core 17 is designed to have a length in its longitudinal direction substantially identical to that of the recording medium P. Further, the coil 18 has a longitudinal length longer than that of the magnetic core 17, and the sleeve 10 has a longitudinal length longer than that of the coil 18.

However, as shown in FIG. 16, the sleeve guiding member 16c functioning as a sliding surface (layer) with respect to the sleeve 10 in the nip N is present between the sleeve 10 and the magnetic core 18, thus resulting in a gap d≠0. For this reason, at both end portions of the coil 18 in the longitudinal direction, a magnetic flux does not enter perpendicular to the sleeve 10. As a result, a region of action of the magnetic fluxes is narrowed to cause a temperature-lowering region at both end portions of the sleeve in comparison with a central portion thereof. As a result, as described above, when the longitudinal lengths of the recording medium P and the magnetic core 17 are set to be substantially identical to each other (FIG. 18), the recording medium P has caused fixation failure at end portions in some cases.

On the other hand, when the longitudinal length of the magnetic core 17 is made sufficiently larger than a width (longitudinal length) of the magnetic core 17 in order to suppress the occurrence of fixation failure, the following problems have arisen.

(1) Heat due to an eddy current is always generated also at a non-paper feeding region of the sleeve 10, and in the region, there is no heat removal by the recording medium. As a result, the sleeve 10 causes excessive temperature rise in the non-paper feeding region, thus being undesirably damaged.

(2) With the extension of longitudinal length of the magnetic core 17, the coil 18 is also required to be extended. However, if the longitudinal length of the coil 18 is made too large, heat dispersion from the end portions of the sleeve 10 is considerably increased, thus remarkably lowering a power efficiency.

SUMMARY OF THE INVENTION

The present invention has accomplished in view of the above-mentioned problems.

An object of the present invention is to provide an image heating apparatus capable of suppressing an occurrence of heating failure of an image.

Another object of the present invention is to provide an image heating apparatus capable of suppressing excessive temperature rise in a region through which a recording medium does not passes.

According to the present invention, there is provided an image heating apparatus for heating an image formed on a recording material, comprising:

a heating member having a heat-generating layer, and magnetic field-generating means for generating a magnetic field to induce an eddy current in said heat-generating layer, said magnetic field-generating means comprising a core and a coil disposed around said core in a longitudinal direction of said core;

wherein said coil has a minimum length L1 and a maximum length L2 respectively in a longitudinal direction thereof; said core has a maximum length Lc in the longitudinal direction thereof; said core and said heating layer form a gap d therebetween; and the recording material has a prescribed maximum size giving a passing width Lp, satisfying the following relationship:

$$Lp+2(2d+1)\leqq Lc\leqq L1<L2.$$

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Embodiment 1

(1) Image Forming Apparatus

Figure 1:
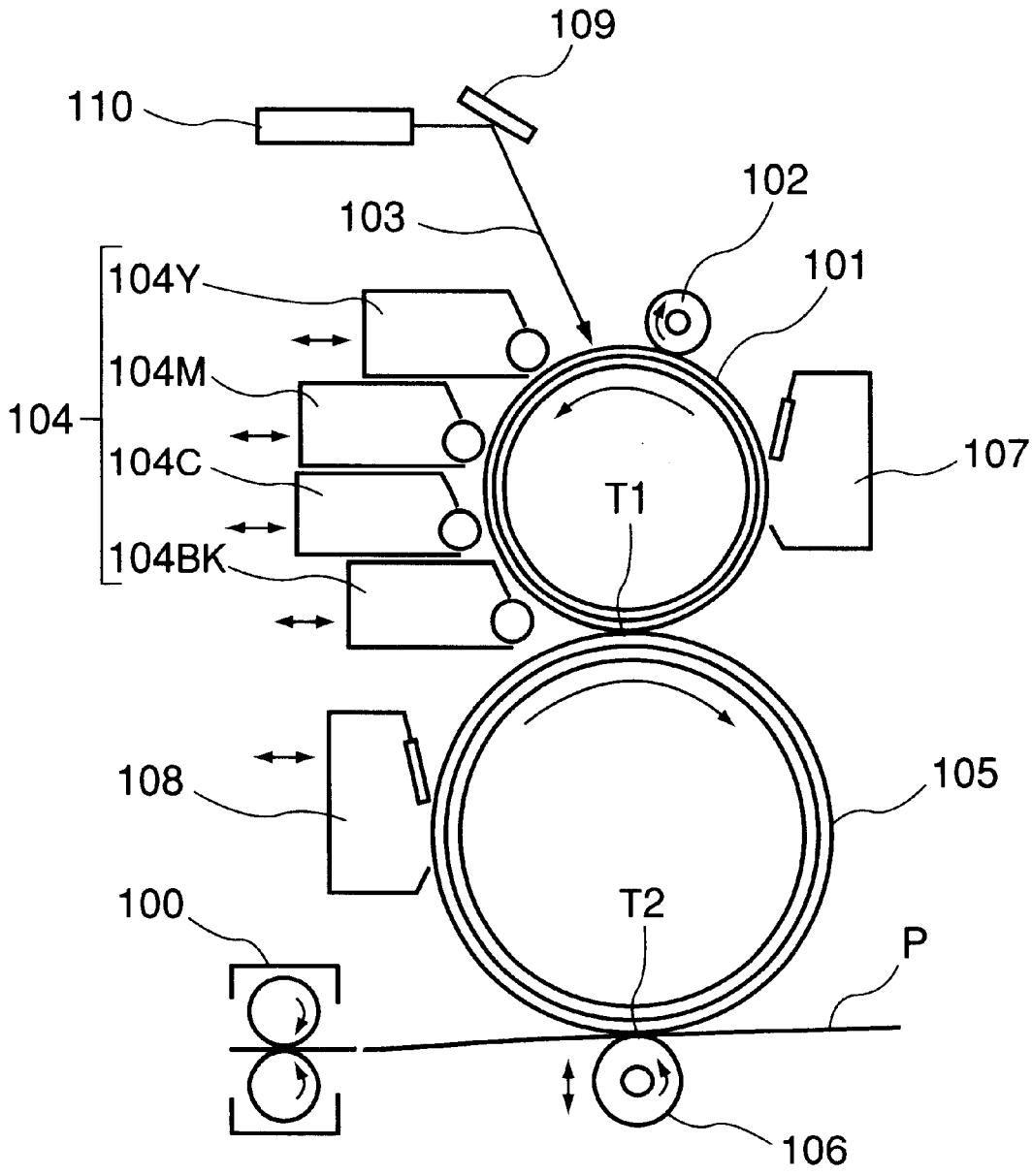
FIG. 1 is a schematic sectional view of a full-color image forming apparatus in which the image heating apparatus according to the present invention is mounted.

FIG. 1 is a schematic sectional view of an example of an image forming apparatus enabled to employ a heating apparatus in accordance with the present invention, as a fixing apparatus 100. In this embodiment, the image forming apparatus is a color laser printer.

A reference numeral 101 designates a photosensitive drum (image bearing member), the photosensitive portion of which is formed of organic photoconductor or amorphous silicon. The photosensitive drum 101 is rotationally driven in the clockwise direction indicated by an arrow at a predetermined process speed (peripheral velocity).

While the photosensitive drum 101 is rotationally driven, its peripheral surface is uniformly charged to predetermined polarity and potential level, by a charging apparatus 102 such as a charging roller.

The uniformly charged surface of the photosensitive drum 101 is scanned by a beam of laser light 103 outputted, while being modulated with the image formation data of an intended image, from a laser optical box 110 (laser scanner); the laser optical box 110 outputs the laser beam 103 from an unshown image signal generating apparatus such as an image reading apparatus, while modulating (turning on or off) it with sequential electrical digital picture element signals in accordance with the image formation data of an intended image. As a result, an electrostatic latent image in accordance with the image formation data of the intended image is formed on the scanned peripheral surface of the photosensitive drum 101. Designated by a reference numeral 109 is a mirror for deflecting the laser beam 103 outputted from the laser optical box 110, toward a specific point on the peripheral surface of the photosensitive drum 101, which is to be exposed.

When forming a full-color image, a latent image correspondent to a first color component, for example, yellow component, of an intended full-color image is formed on the uniformly charged peripheral surface of the photosensitive drum 101 by scanning the peripheral surface of the photosensitive drum 101 with the laser beam modulated with the image formation data correspondent to the first color (yellow) component of the intended full-color image. Then, the latent image is developed into a yellow toner image by the activation of the yellow color developing device 104Y, which is one of the four color developing apparatuses 104. Then, the yellow toner image is transferred onto the surface of the intermediary transfer drum 105, in the primary transfer portion T1, that is, the interface (inclusive of the adjacencies thereto) between the photosensitive drum 101 and intermediary transfer drum 105. After the transfer of the yellow toner image onto the surface of the intermediary transfer drum 105, the peripheral surface of the photosensitive drum 101 is cleaned with a cleaner 107; the residues, for example, toner particles, remaining on the peripheral surface of the photosensitive drum 101, are removed by the cleaner 107.

The above described process cycle comprising charging, scanning/exposing, developing, primary transferring, and cleaning processes is carried out in sequence for the second (for example, magenta color, activation of magenta color developing device 104M), third (for example, cyan color; activation of cyan color developing device 104C), and fourth (for example, black color; activation of black color developing device 104BK) color components of the intended full-color image. As a result, four color toner images, that is, the yellow toner image, magenta toner image, cyan toner image, and black toner image, are placed in layers on the surface of the intermediary transfer drum 105, creating a color toner image virtually identical to the intended full-color image.

The intermediary transfer drum 105 comprises a metallic drum, an elastic layer coated on the peripheral surface of the metallic drum, and a surface layer coated over the elastic layer. The electrical resistances of the elastic layer and surface layer are in the medium and high ranges, respectively. The intermediary transfer drum 105 is disposed so that its peripheral surface remains in contact with, or close to, the peripheral surface of the photosensitive drum 101. It is rotationally driven in the clockwise direction indicated by an arrow at approximately the same peripheral velocity as that of the photosensitive drum 101. The toner image on the peripheral surface of the photosensitive drum 101 is transferred onto the peripheral surface of the intermediary transfer drum 105 by creating a difference in potential level between the peripheral surfaces of the intermediary transfer drum 105 and photosensitive drum 101. As for the method for creating this potential level difference, bias voltage is applied to the metallic drum of the intermediary transfer drum 105.

The color toner images on the intermediary transfer drum 105 are transferred onto a recording medium P (which hereinafter will be referred to as transfer medium or paper), in a secondary transfer portion T2, that is, the nip, or interface, between the peripheral surface of the intermediary transfer drum 105 and photosensitive drum 101. More concretely, the recording medium P is conveyed into the secondary transfer portion T2 from an unshown sheet feeding portion at a prescribed timing. As the recording medium P is conveyed through the secondary transfer portion T2, such electrical charge that is opposite in polarity to the toner is supplied to the transfer medium P from the back surface side of the transfer medium P. As a result, the four color toner images, or the four components of a superposed full-color image, are transferred all at once onto the transfer medium P from the peripheral surface of the intermediary transfer drum 105.

After passing through the secondary transfer portion T2, the transfer medium P is separated from the peripheral surface of the intermediary transfer drum 105, and is introduced into the fixing apparatus 100 (image heating apparatus), in which the unfixed color toner images are thermally fixed to the transfer medium P. Then, the transfer medium P is discharged into an unshown external delivery tray.

After the transfer of the color toner images onto the transfer medium P, the intermediary transfer drum 105 is cleaned by a cleaner 108; the residues, such as toner particles or paper dust, remaining on the peripheral surface of the intermediary transfer drum 105 are removed by the cleaner 108.

Normally, the cleaner 108 is not kept in contact with the intermediary transfer drum 105; it is kept in contact with the intermediary transfer drum 105 only while the color toner images are transferred (secondary transfer) from the intermediary transfer drum 105 onto the transfer medium P.

Normally, the transfer roller 107 is not kept in contact with the intermediary transfer drum 105; it is kept pressed against the intermediary transfer drum 105, with the interposition of the transfer medium P, only while the color toner images are transferred (secondary transfer) from the intermediary transfer drum 105 onto the transfer medium P.

The image forming apparatus in this embodiment is capable of carrying out a monochromatic printing mode; for example, it can prints a black-and-white image. It also is capable of carrying out a double-sided printing mode.

In a double-side printing mode, after the formation of an image on one of the two surfaces of the transfer medium P, the transfer medium P is put through the fixing apparatus 100. Then, it is turned over through an unshown recirculating/conveying mechanism, and is sent again into the secondary transfer portion T2, in which a single or plurality of toner images are transferred onto the other surface of the transfer medium P. Then, the transfer medium P is introduced for the second time into the fixing apparatus 100, in which the unfixed toner image or images on the second surface are fixed to the second surface. Then, the transfer medium P is discharged as a double-sided print.

(2) Fixing Apparatus 100

A) General Structure of Fixing Apparatus

Figure 2:
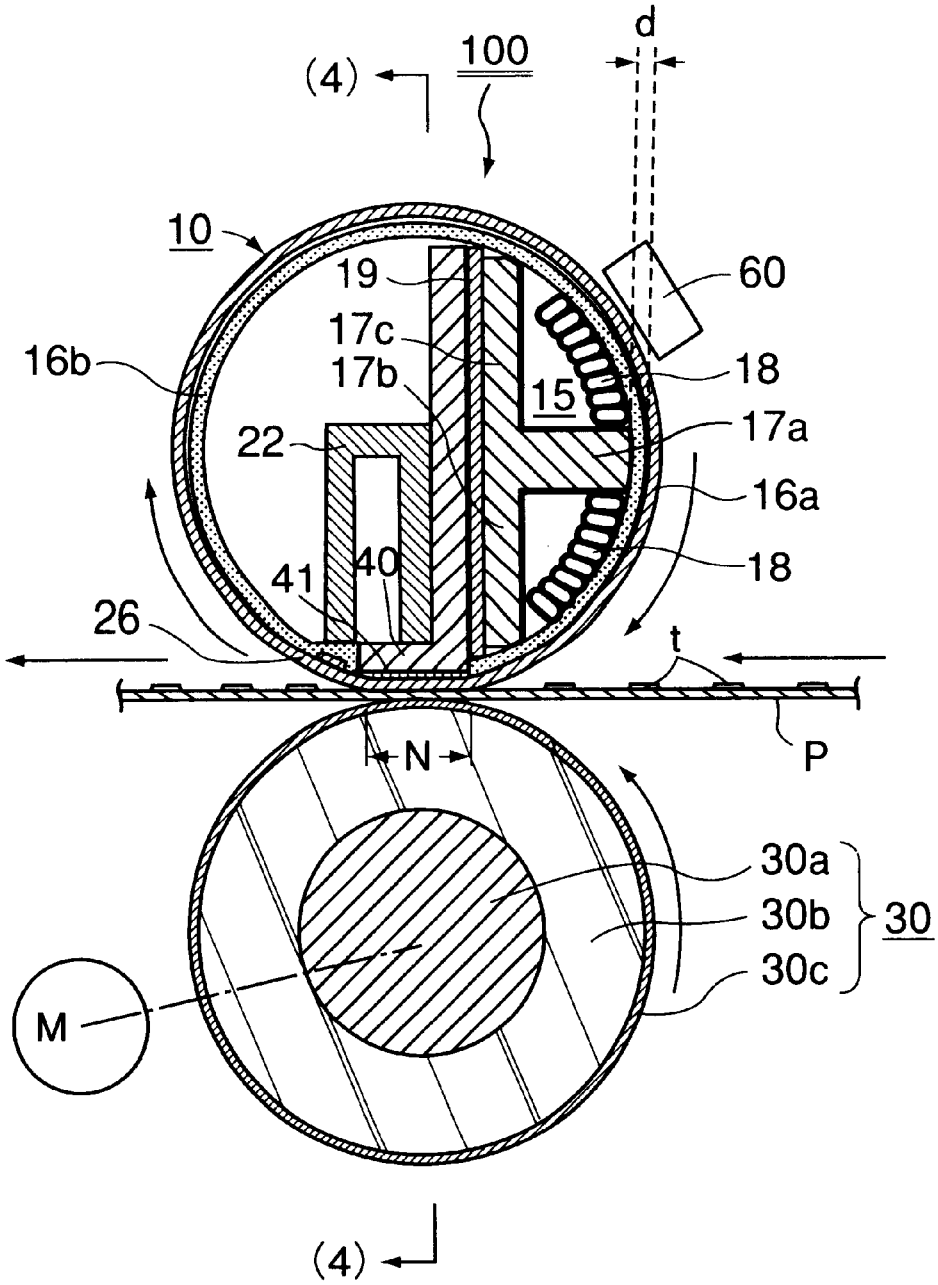
FIG. 2 is a schematic sectional view of the essential portion of the image heating apparatus of the present invention.
Figure 3:
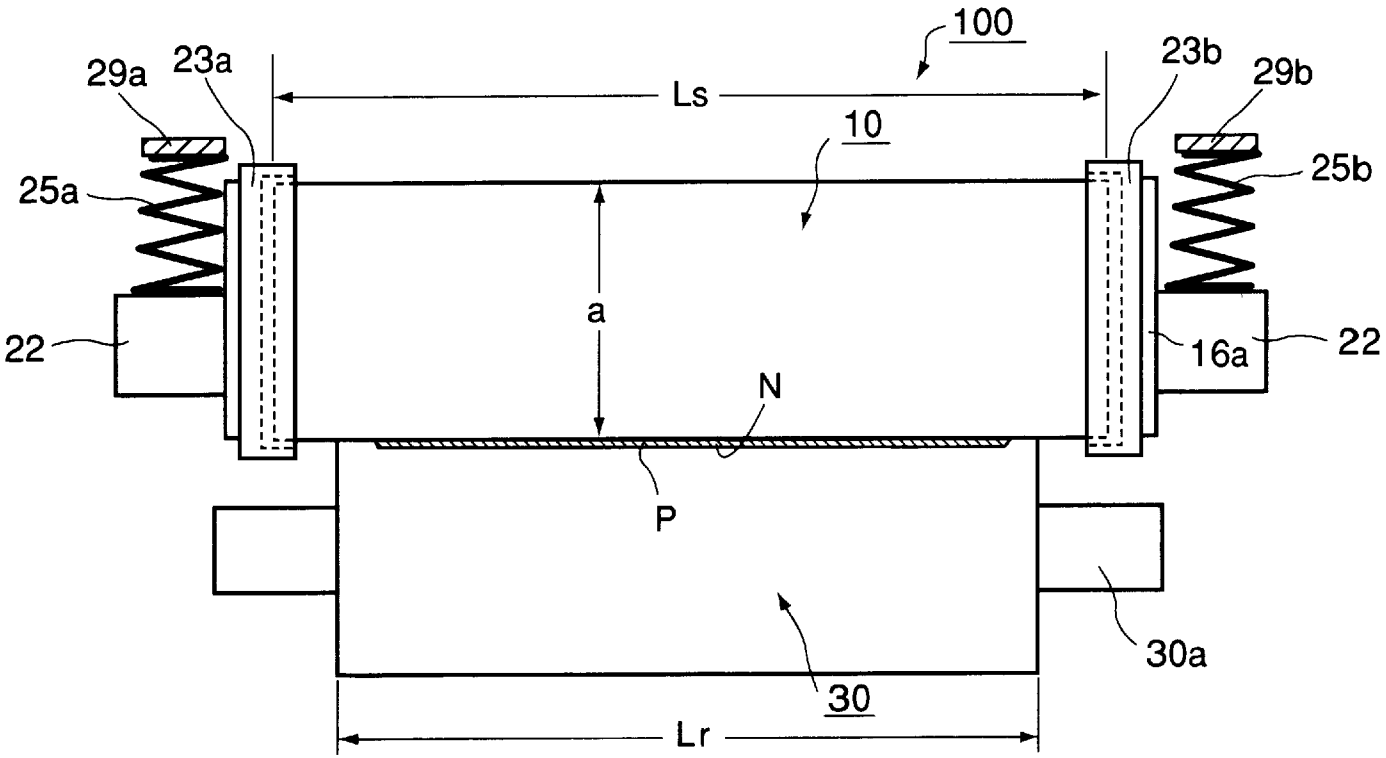
FIG. 3 is a schematic sectional view of the essential portion of the image heating apparatus of FIG. 2, as seen from the front side of the apparatus.
Figure 4:
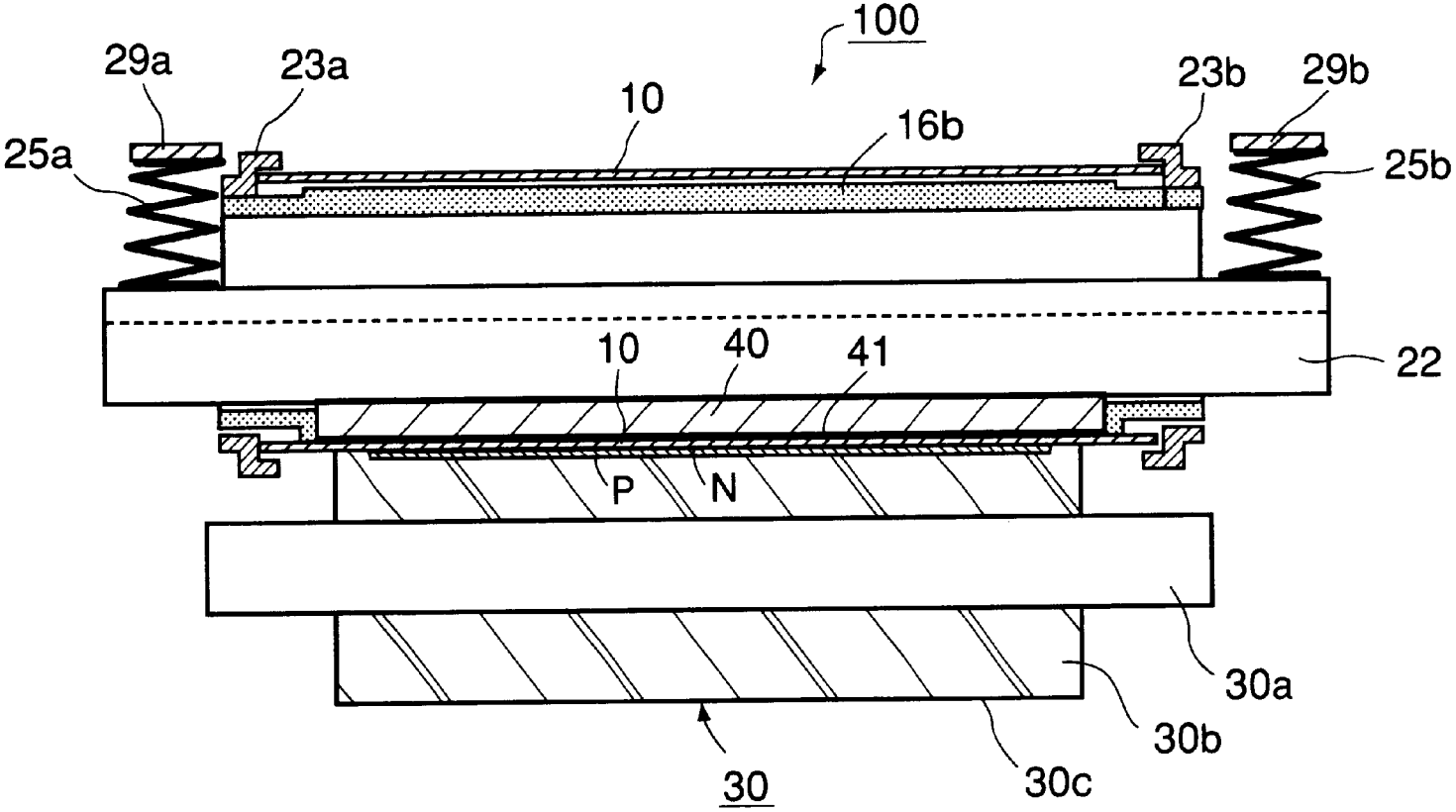
FIG. 4 is a vertical sectional view of the essential portion of the image heating apparatus of FIG. 2, at the vertical plane inclusive of the axial line of the pressure roller of the fixing apparatus.

The fixing apparatus 100 in this embodiment is of an electromagnetic induction heating type. FIG. 2 is a schematic sectional view of the essential portion of the fixing apparatus 100 in this embodiment, at a vertical plane perpendicular to the axial line of the pressure roller of the fixing apparatus 100. FIG. 3 is a schematic front view of the essential portion of the fixing apparatus 100. FIG. 4 is a schematic sectional view of the essential portion of the fixing apparatus 100, at the vertical plane inclusive of the axial line of the pressure roller of the fixing apparatus 100 (plane viewed along (4)—(4) line in FIG. 2).

Figure 16:
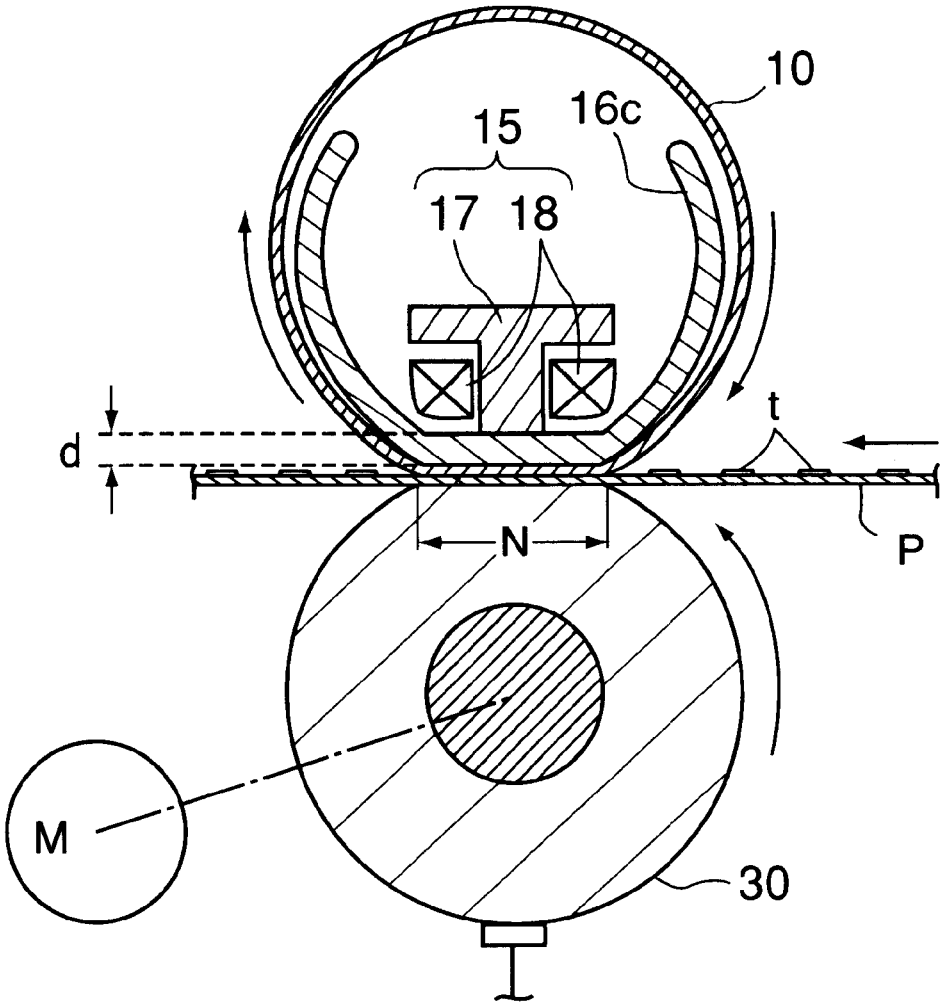
FIG. 16 is a schematic sectional view of the essential portion of a conventional image heating apparatus.
Figure 17:
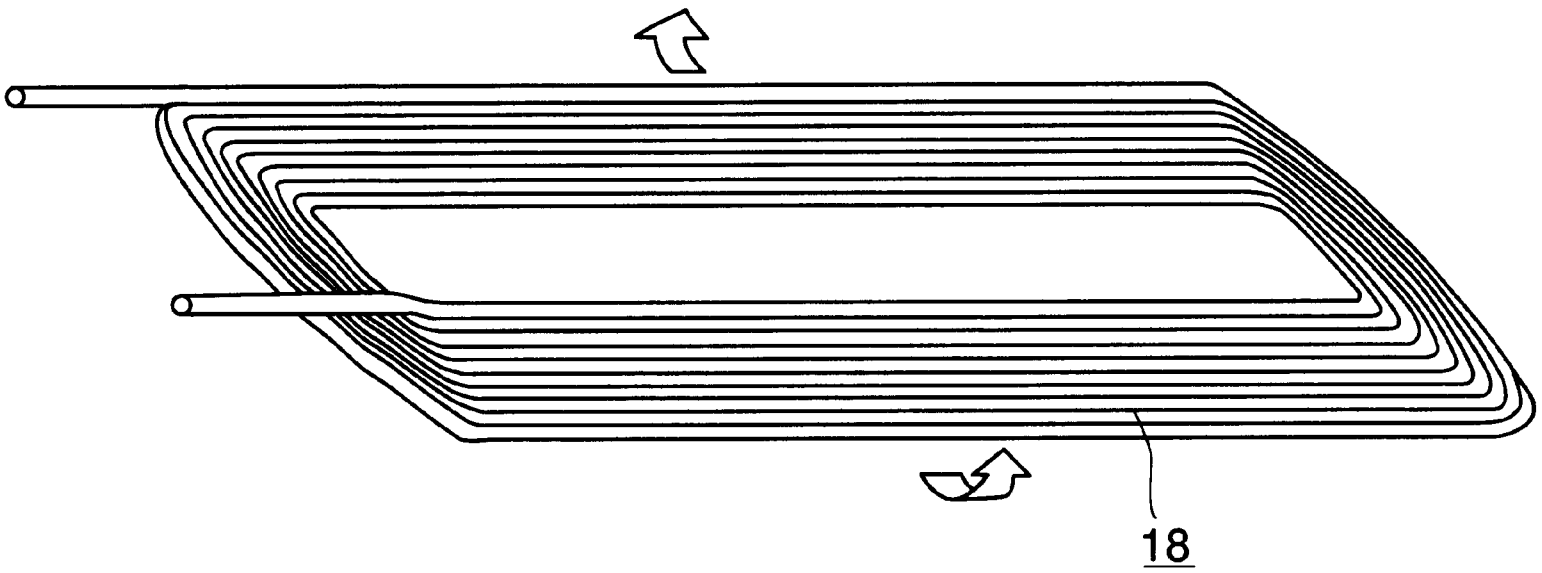
FIG. 17 is a schematic perspective view of an exciting oil before deformation thereof in a direction of arrows.
Figure 18:
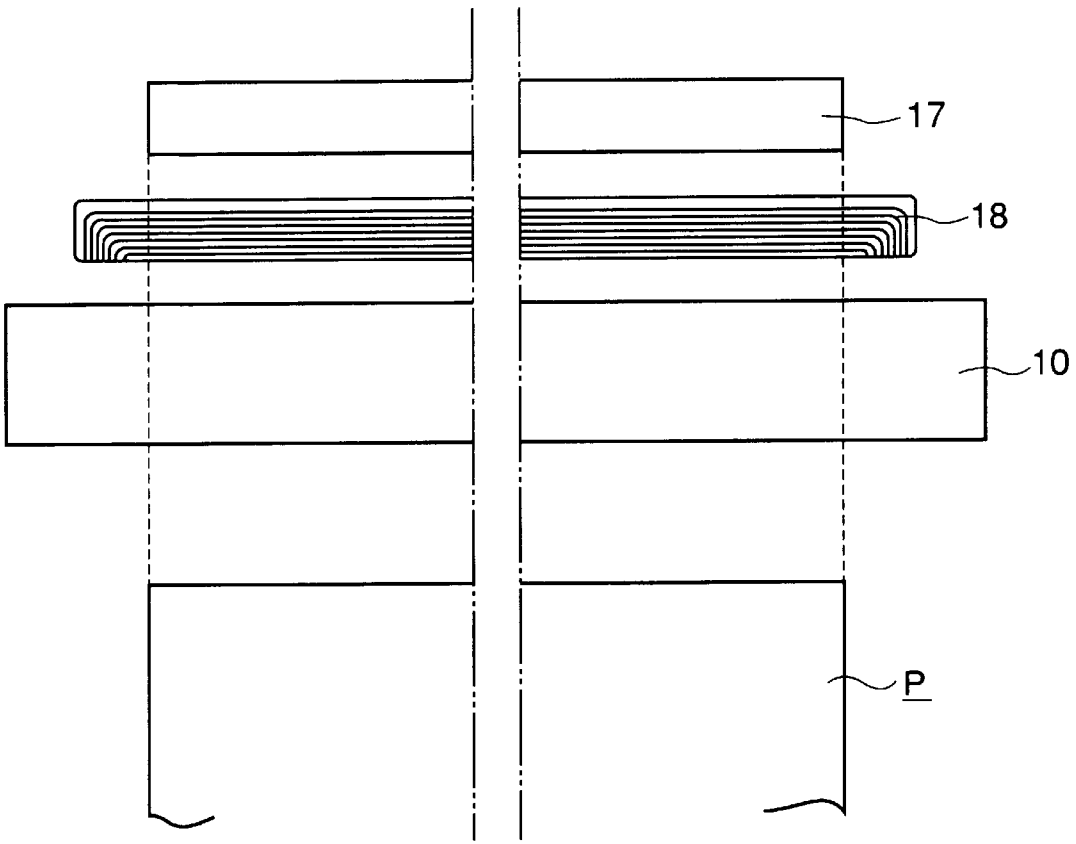
FIG. 18 is a schematic drawing for showing a dimensional relationship in longitudinal direction among respective structural members of the image heating apparatus.

This apparatus 100 is similar to the fixing apparatus shown in FIG. 16. In other words, it is of a pressure roller driving type and also, of an electromagnetic induction heating type, and employs, as a rotational fixing member (fixing sleeve), a cylindrical electromagnetic induction heating sleeve (heating member) formed of film. The structural members and portions of this fixing apparatus 100 identical in function to those of the apparatus shown in FIG. 16 will be given the same reference numeral as the reference numeral given to those of the apparatus shown in FIG. 16, in order to avoid the repetition of the same descriptions.

A magnetic field (flux) generating means 15 comprises magnetic cores 17*a,* 17*b,* and 17*c,* and an exciting coil 18.

The magnetic cores 17*a,* 17*b,* and 17*c* need to be high in permeability. Therefore, they are desired to be formed of such material as ferrite or permalloy that is used as the material for a transformer core, preferably, such ferrite that is relatively small in loss even in a frequency range of no less than 100 kHz.

The power supplying portions 18*a* and 18*b* (FIG. 5) of the exciting coil 18 are connected to an exciting circuit 27, which is enabled to generate high frequency alternating current, the frequency of which is in a range of 20 kHz to 500 kHz, with the use of a switching power source.

As the alternating current (high frequency current) is supplied to the exciting coil 18 from the exciting circuit 27, the exciting coil 18 generates an alternating magnetic flux.

Designated by reference numerals 16*a* and 16*b* are sleeve guiding members, which are in the form of a trough having a semicircular cross section. They are joined so that the open sides of the two sleeve guiding members 16*a* and 16*b* face each other, creating a substantially cylindrical guiding member. Around the thus formed cylindrical guiding member, a cylindrical and rotational electromagnetic induction heating sleeve 10, which has a length Ls of 283 mm and an external diameter a of 34 mm, is loosely fitted.

The sleeve guiding member 16*a* internally holds the magnetic cores 17*a,* 17*b,* and 17*c,* and exciting coil 18,as the components of the magnetic field generating means 15.

The sleeve guiding member 16*a* also internally holds a highly heat conductive member 40 relatively high in thermal conductivity. The highly heat conductive member 40 is disposed inside the loop of the sleeve 10, and squarely faces the portion of the pressure roller 30 in the fixing nip N. It also functions as a member for backing up the sleeve 10 from inside the loop of the sleeve 10.

In this embodiment, aluminum plate with a thickness of 1 mm is used as the material for the highly heat conductive member 40.

In order to prevent the highly heat conductive member 40 from being affected by the magnetic field generated by the magnetic field generating means 15 comprising the exciting coil 18 and magnetic cores 17*a,* 17*b,* and 17*c,* the highly heat conductive member 40 is disposed outside the magnetic field.

A reference numeral 22 designates a rigid pressure application stay disposed in contact with the highly heat conductive member 40, on the surface opposite to the surface in contact with the portion of the internal surface correspondent to the nip N, and also in contact with the inwardly facing flat surface of the sleeve guiding member 16*b*. It extends in the direction parallel to the lengthwise direction of the sleeve 10.

A reference numeral 19 designates an insulating member for insulating between the combination of the magnetic cores 17*a,* 17*b,* and 17*c,* and exciting coil 18, and the rigid pressure application stay 22.

Flanges 23*a* and 23*b* (FIGS. 3 and 4) are rotatably attached to the lengthwise ends, one for one, of the assembly made up of the sleeve guiding members 16*a* and 16*b,* while being regulated in terms of their movements in the lengthwise direction of the sleeve 10. While the sleeve 10 is rotated, the flanges 23*a* and 23*b* catch the sleeve 10 by its edges, regulating thereby the movement of the sleeve 10 in the direction parallel to the lengthwise direction of the sleeve 10.

The pressure roller 30 as a pressure applying member comprises: a metallic core 30*a;* a heat resistant elastic layer 30*b* coaxially formed around the metallic core; and a release layer 30*c* as a surface layer (approximately 10 $\mu$m–100 $\mu$m thick). The elastic layer is formed of heat resistant substance such as silicone rubber, fluorinated rubber, fluorinated resin, or the like, and the release layer 30*c* is formed of fluorinated resin such as PFA, PTFE, FEP, or the like. The pressure roller 30 is rotatably supported between the side plates of the unshown chassis of the fixing apparatus; the lengthwise ends of the metallic core 30*a* are supported by the bearings attached to the side plates of the unshown chassis of the fixing apparatus. In this embodiment, a pressure roller 30 which is 250 mm in the pressure application range length Lr and 20 mm in external diameter, was employed. The full length Ls of the sleeve 10 is greater than the pressure application range length Lr of the pressure roller 30. A dimensional relationship in longitudinal direction among these members will be described in more detail layer, in Section D.

The rigid pressure application stay 22 is kept pressed downward by placing compressed compression springs 25*a* and 25*b* between the lengthwise end of the rigid pressure application stay 22 and the spring seats 29*a* and 29*b* of the fixing apparatus chassis, respectively. With the provision of this structural arrangement, the downwardly facing surface of the portion of the highly heat conductive member 40, correspondent to the nip N, is pressed upon the upwardly facing portion of the peripheral surface of the pressure roller 30, with the interposition of the fixing sleeve 10, thus forming the fixing nip N with a predetermined width.

In this embodiment, the pressure (linear pressure) generated in the nip N by the pressure roller 30 was set to approximately 7.8 N/cm (800 g/cm).

In order to maintain the width of the nip N at a certain value, it is not desirable that the hardness of the pressure roller 30 is greater than a certain value. More concretely, in order to maintain the width of the nip N at a desired value, the hardness of the pressure roller 30 is desired to be no more than 75 degrees (upper limit), whereas from the standpoint of mechanical strength of the pressure roller 30, the hardness of the pressure roller 30 is desired to be no less than approximately 45 degrees (lower limit) (measured as Asker C hardness with the application of 9.8N (1 kg) to the surface layer of the pressure roller).

In this embodiment, the hardness of the pressure roller 30 was set to approximately 56 degrees, forming the fixing nip N with a width of approximately 7 mm in terms of the transfer medium conveyance direction.

The pressure roller 30 is rotationally driven by a driving means M in the counterclockwise direction indicated by an arrow. As the pressure roller 30 is rotationally driven, the sleeve 10 is rotated around the sleeve guiding members 16*a* and 16*b* by the friction between the peripheral surface of the pressure roller 30 and the sleeve 10, in the clockwise direction indicated by an arrow, at a peripheral velocity substantially equal to the peripheral velocity of the pressure roller 30, with the inwardly facing surface of the sleeve 10 sliding on the bottom surface of the highly heat conductive member 40, in the fixing nip N.

In order to reduce the friction between the bottom surface of the highly heat conductive member 40 and the internal surface of the sleeve 10 in the fixing nip N, lubricant such as heat resistant grease may be placed between the bottom surface of the highly heat conductive member 40 and the internal surface of the sleeve 10, or the bottom surface of the highly heat conductive member 40 may be covered with a lubricous member 41 to allow the sleeve 10 to more smoothly slide on the highly heat conductive member 40 in the nip N. This is done for preventing the following problem: when substance such as aluminum, which is not lubricous, is used as the material for the highly heat conductive member 40, or when the process for finishing the highly heat conductive member 40 is simplified, it is possible that as the sleeve 10 slides on the highly heat conductive member 40, the highly heat conductive member 40 will damage the sleeve 10, adversely affecting the durability of the sleeve 10.

The highly heat conductive member 40 member is effective to make uniform the heat distribution in terms of the lengthwise (longitudinal) direction. For example, when a small-sized sheet of paper is passed as the transfer medium P (recording medium) through the fixing apparatus, the heat in the portions of the sleeve 10 outside the path of the sheet of paper is efficiently conducted, in the lengthwise direction of the conductive member 40, to the portion of the conductive member 40 correspondent to the path of the small sheet of paper, reducing the electrical power consumed when a small-sized sheet of paper is passed through the fixing apparatus.

Figure 5:
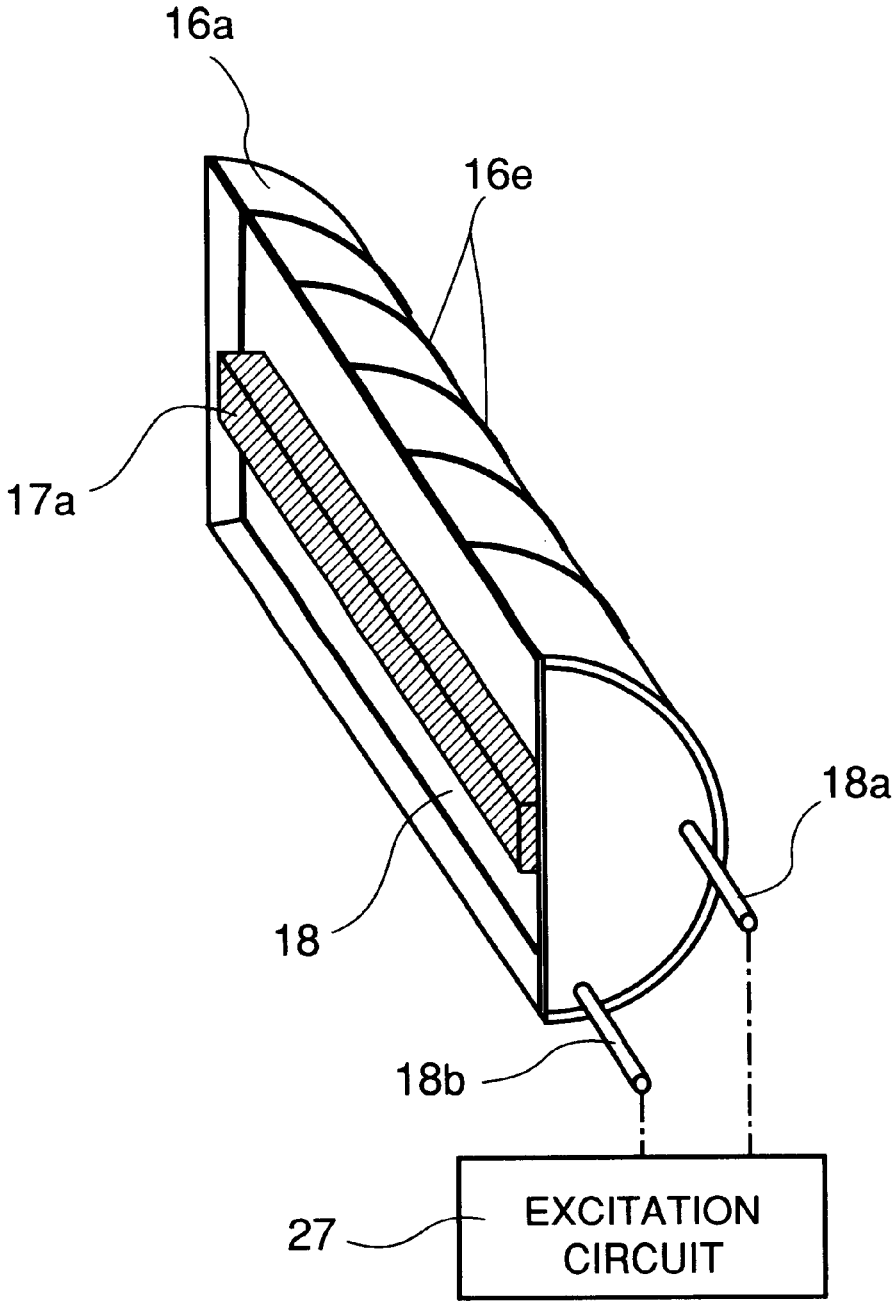
FIG. 5 is a perspective schematic view showing a right-half of a sleeve guiding member in which a magnetic field generating means is disposed.

Referring to FIG. 5, in order to reduce the load which applies to the sleeve 10 as the sleeve 10 is rotated, the peripheral surface of the sleeve guiding member 16*a* is provided with a plurality of ribs 16*e,* which extend perpendicular to the lengthwise direction of the sleeve guiding member 16*a,* following the curvature, and are evenly distributed in the lengthwise direction of the sleeve guiding member 16*a,* with the provision of predetermined intervals, for reducing the friction which occurs between the peripheral surface of the sleeve guiding member 16*a* and the internal surface of the sleeve 10 as the sleeve 10 slides on the sleeve guiding member 16*a.* The sleeve guiding member 16*b* may also be provided with a plurality of ribs such as those provided on the peripheral surface of the sleeve guiding member 16*a.*

Figure 6:
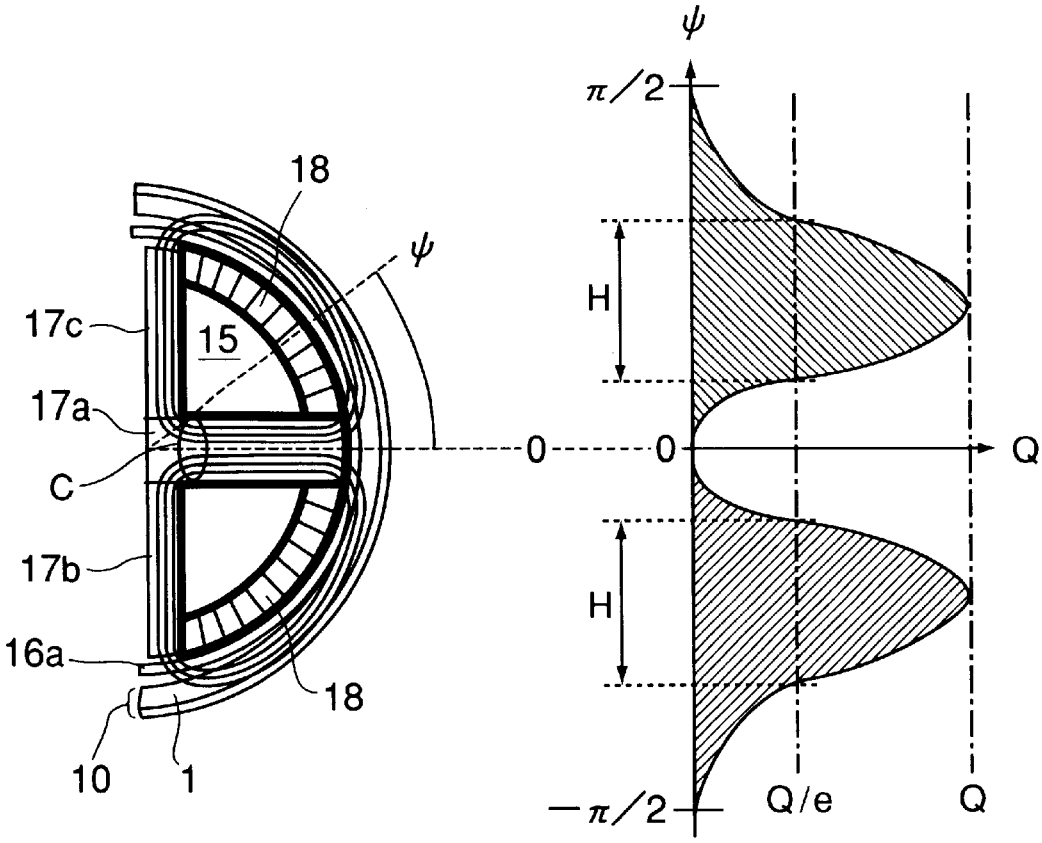
FIG. 6 is a schematic drawing for showing a relationship between the magnetic field generating means and an amount (Q) of heat generation (Q).

FIG. 6 is a schematic drawing for showing the characteristics of the alternating magnetic flux. A magnetic flux C in the drawing represents a portion of the alternating magnetic flux generated by the magnetic field generating means.

Being guided by the magnetic cores 17*a,* 17*b* and 17*c,* the alternating magnetic flux C induces eddy currents in the electromagnetic induction based heat generating layer 1 of the sleeve 10, between the magnetic cores 17*a* and 17*b,* and between the magnetic cores 17*a* and 17*c.* These eddy currents generate heat (Joule heat, or eddy current loss) in the electromagnetic induction based heat generating layer 1, in cooperation with the specific resistance of the electromagnetic induction based heat generating layer 1.

The amount Q of the heat generated in the electromagnetic induction based heat generating layer 1 is determined by the density of the magnetic flux which passes through the electromagnetic induction heat generating layer 1, and the heat distribution is as depicted by the graph in FIG. 6. In the graph, the axis of abscissas stands for the position of a given point of the sleeve 10 represented in the angle ø between the line connecting the given point of the sleeve 10 and the center of the inward surface of the magnetic core 17*a,* and the line connecting the centers of the inward and outward surfaces of the magnetic core 17*a,* whereas the axis of ordinates stands for the amount Q of the heat generated in the electromagnetic induction heat generating layer 1 of the sleeve 10. The heat generating ranges H in the graph are the ranges in which heat is generated by no less than Q/e in the electromagnetic induction heat generating layer 1; in other words, they are the ranges in which heat is generated in the electromagnetic induction heat generating layer 1 by the amount sufficient for image fixation. In this case, similarly as in the case of the above-described conventional fixing (image heating) apparatus, the peak value Q is apparently lowered at an end portion of the sleeve 10.

The temperature of the fixing nip N is kept at a predetermined level; the electric current supplied to the exciting coil 18 is controlled by a temperature control system inclusive of a temperature detecting means 26 (FIG. 2).

The temperature detecting means 26 is a temperature sensor, such as a thermistor, for detecting the temperature of the sleeve 10. In this embodiment, the temperature of the fixing nip portion N is controlled based on the temperature measured by the temperature sensor 26. In this embodiment, the surface temperature of the sleeve 10 at a central portion thereof is controlled to be kept at approximately 180° C.

As an image forming apparatus is turned on, the sleeve 10 begins to be rotated, and electrical power is supplied to the exciting coil 18 from the exciting circuit 27. As a result, the temperature of the fixing nip portion N is raised to the predetermined level by the heat electromagnetically generated in the sleeve 10. In this state, the transfer medium P, which has been conveyed from the image forming portion after the formation of an unfixed toner image t on the transfer medium P, is introduced into the fixing nip portion N, that is, the interface between the sleeve 10 and pressure roller 30, with the image bearing surface of the transfer medium P facing upward, in other words, facing the sleeve 10. Then, the transfer medium P is conveyed with the sleeve 10 through the fixing nip portion N, the image bearing surface of the transfer medium P being kept perfectly in contact with the peripheral surface of the sleeve 10, by the pressure roller 30.

While the transfer medium P is conveyed with the sleeve 10 through the fixing nip portion N, being sandwiched by the sleeve 10 and pressure roller 30, the unfixed toner image t on the transfer medium P is thermally fixed to the transfer medium P.

After being passed through the fixing nip portion N, the transfer medium P is released from the peripheral surface of the sleeve 10, and is conveyed further to be discharged from the image forming apparatus.

After being thermally fixed to the transfer medium P while the transfer medium P is passed through the fixing nip portion N, the toner image cools down to become a permanent (fixed) toner image.

In this embodiment, the fixing apparatus is provided with a thermo-switch 60 as a temperature detecting element for shutting off the power supply to the exciting coil 18 if the fixing apparatus goes out of control. The thermo-switch 60 is disposed opposite to the portion of the sleeve 10 in one of the heat generating ranges H, as shown in FIG. 2.

Figure 7:
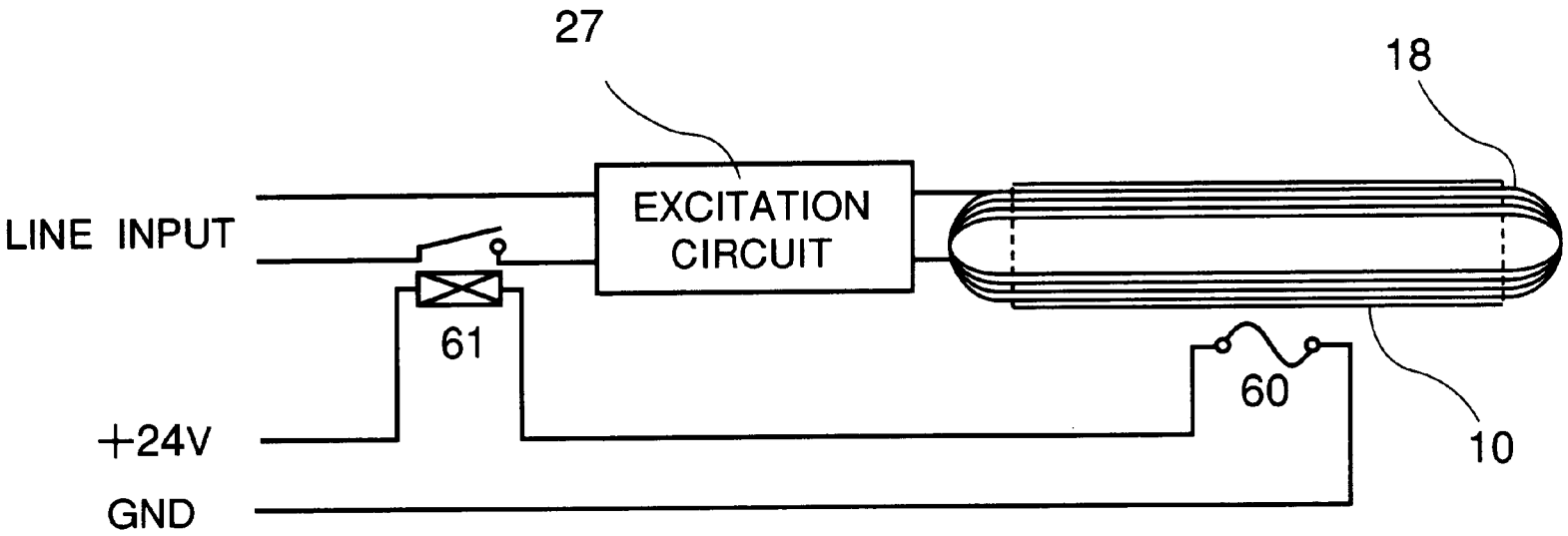
FIG. 7 is a diagram of the safety circuit.

FIG. 7 is the diagram for the safety circuit used in this embodiment. The thermo-switch 60 as a temperature detecting element is connected in series with a 24 V DC power source and a relay switch 61. The turn-off of the thermo-switch 60 immediately shuts off the power supply to the relay switch 61, turning off the relay switch 61. The turn-off of the relay switch 61 shuts off the power supply to the exciting circuit 27, which in turn shuts off the power supply to the exciting coil 18. The thermo-switch 60 in this embodiment was set up so that it would turn off at 220° C.

As described above, the thermo-switch 60 is disposed oppositely adjacent to the portion of the sleeve 10 in one of the heat generating ranges H, with no contact between the thermo-switch 60 and the peripheral surface of the sleeve 10. The distance between the thermo-switch 60 and sleeve 10 in this embodiment was set to approximately 2 mm. This provision can prevent the sleeve 10 from being damaged by the contact with the thermo-switch 60 and prevent a deterioration of the fixed image with time.

In the case of the above described fixing apparatus shown in FIG. 16, heat is generated in the fixing nip N. In comparison, in the case of the fixing apparatus in this embodiment, which is different in structure from the fixing apparatus shown in FIG. 16, heat is not generated in the fixing nip N. Thus, even if the fixing apparatus in this embodiment goes out of control and keeps on supplying the exciting coil 18 with power, generating therefore heat in the sleeve 10, while the fixing apparatus is stuck, with a sheet of paper P (transfer medium) remaining pinched in the fixing nip portion N, it does not occur that the sheet of paper P stuck in the fixing nip portion N is directly heated, because heat is not generated in the fixing nip portion N in which the sheet of paper P is stuck. Further, the thermo-switch 60 is disposed adjacent to the portion of the sleeve 10 in one of the ranges H in which a relatively large amount of heat is generated. Therefore, as soon as the temperature of the portion of the sleeve 10 in the heat generating range H reaches 220° C., this temperature is sensed by the thermo-switch 60, and the thermo-switch 60 turns itself off, shutting off the power supply to be supplied to the exciting coil 18 through the relay switch 61.

Since the ignition temperature of paper is approximately 400° C., the thermo-switch 60 in this embodiment can stop the heat generation in the sleeve 10, without allowing the sheet of paper in the fixing nip portion N to ignite. Incidentally, in place of the thermo-switch 60, a thermal fuse may be used as a temperature detecting element.

In this embodiment, toner t which contains such substances that soften at a relatively low temperature, was used as developer. Therefore, the fixing apparatus is not provided with an oil coating mechanism for preventing off-set.

B) Exciting Coil 18

As for the assembly of the exciting coil 18, first, a plurality of fine copper wires which were individually coated with insulating material, were bundled. Then, the exciting coil 18 was formed by winding, a predetermined number times, the bundle of the plurality of fine copper wire coated with the insulating material in a direction along the longitudinal direction of the core 17*a*. In this embodiment, the bundle was wound 10 times to form the exciting coil 18.

In consideration of the heat generated in the sleeve 10 and the thermal conductivity, a heat resistant substance such as polyamide-imide, polyimide, or the like, should be used as the material for the insulation for the fine copper wires.

The wire density of the exciting coil 18 may be increased by the application of external pressure.

Referring to FIGS. 2 and 6, the exciting coil 18 is wound in such a shape that a portion thereof parallel to its longitudinal direction is disposed along an inner shape, i.e., a curvature (curved surface) of the heat generating layer 1 of the sleeve 10. In this embodiment, a structural arrangement was made so that the distance between the heat generating layer 1 of the sleeve 10 and the exciting coil 18 became approximately 2.5 mm.

The material for the sleeve guiding member 16*a* and 16*b* (exciting coil holding members) is desired to be superior in insulative property and heat resistance; for example, phenolic resin, fluorinated resin, polyimide resin, polyamide resin, polyamide-imide resin, PEEK resin, PES resin, PPS resin, PFA resin, PTFE resin, FEP resin, LCP resin, or the like.

The smaller the distances between the magnetic cores 17*a*, 17*b*, and 17*c* and the sleeve 10, and between the exciting coil 18 and the sleeve 10, the higher the magnetic flux absorption efficiency. If these distances exceed 5 mm, the efficiency drastically drops. Therefore, a structural arrangement should be made so that the distances become no more than 5 mm. Further, the distance between the heat generating layer 1 of the sleeve 10 and exciting coil 18 does not need to be uniform as long as the distance is no more than 5 mm.

In this embodiment, the distance d (FIG. 2) between the heat generating layer 1 of the sleeve 10 and the magnetic core 17*a* was set to be approximately 2 mm by disposing the sleeve guiding member 16*a*.

Each of the lead lines, or the power supplying portion 18*a* and 18*b* (FIG. 5), of the exciting coil 18 extended through the sleeve guiding member 16*a* are covered with insulative coat; the bundle of fine copper wires is covered with a single piece of coat.

C) Sleeve 10

Figure 8:
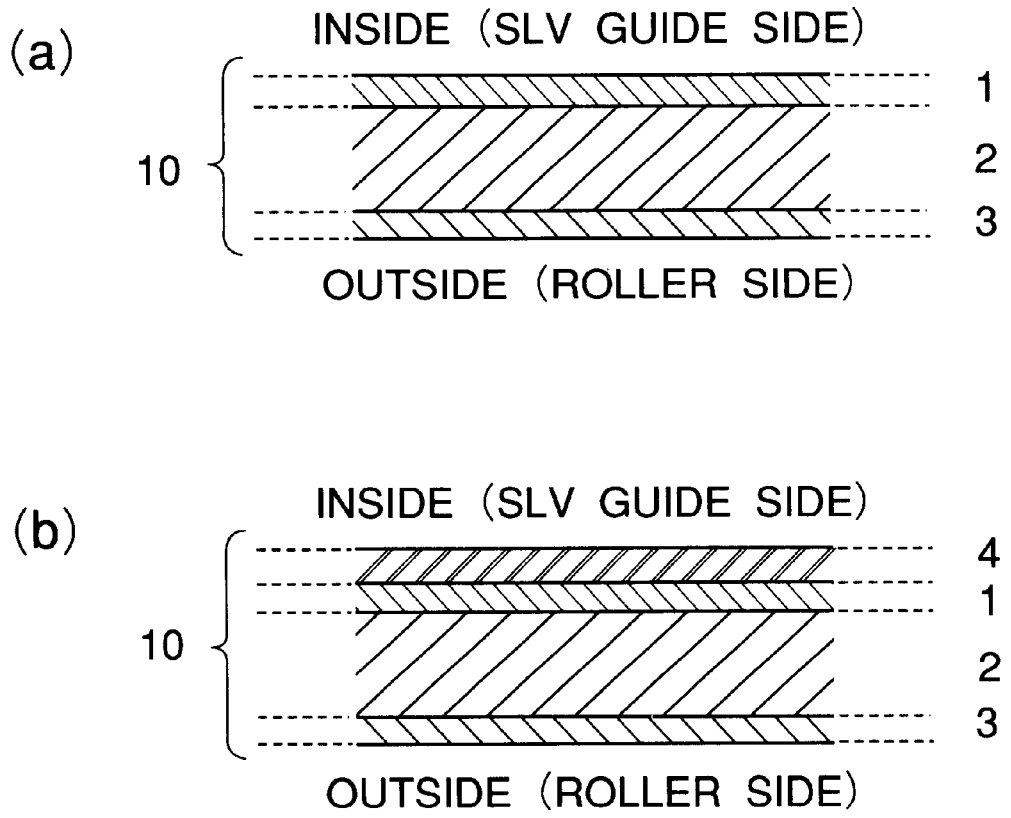
FIG. 8 includes schematic sectional views at (a) and (b) each showing a layer structure of a fixing sleeve of the image heating apparatus.

FIG. 8(*a*) is a schematic sectional view of the sleeve 10 in this embodiment, and shows the laminar structure thereof. The sleeve 10 in this embodiment is a compound sleeve made up of the heat generating layer 1, elastic layer 2, and release layer 3. The heat generating layer 1 also functions as the base layer of the sleeve 10 based on the electromagnetic induction heat generation, and is formed of metallic material. The elastic layer 2 is layered upon the outwardly facing surface of the heat generating layer 1, and the release layer 3 is layered upon the outwardly facing surface of the elastic layer 2.

In order to adhere the heating layer 1 and elastic layer 2 to each other, and the elastic layer 2 and release layer 3 to each other, a primer layer (unshown) may be disposed between the heating layer 1 and elastic layer 2, and between the elastic layer 2 and release layer 3.

The heat generating layer 1 of the substantially cylindrical sleeve 10 is the most inward layer, and the release layer 3 is the most outward layer. As described above, as the alternating magnetic flux acts on the heat generating layer 1, eddy current is induced in the heat generating layer 1, and this eddy current generates heat in the heat generating layer 1, heating the sleeve 10. This heat conducts to the outwardly facing surface of the sleeve 10 through the elastic layer 2 and release layer 3, and heats the transfer medium P, as a medium to be heated, which is being passed through the fixing nip portion N. As a result, the unfixed toner image is thermally fixed to the transfer medium P.

a. Heat Generating Layer 1

As for the material for the heat generating layer 1, a ferromagnetic substance such as nickel, iron, ferromagnetic SUS, or nickel-cobalt alloy is desirable.

Nonmagnetic substance is also usable as the material for the heat generating layer 1, but a metal such as nickel, iron, magnetic stainless steel, or nickel-cobalt alloy, which is superior in magnetic flux absorbency is preferable.

The thickness of the heat generating layer 1 is desired to be no less than the penetration depth σ (mm) obtained by the following equation, and no more than 200 μm:

$$\sigma=503\times(\rho/f\mu)^{1/2}$$

f: frequency (Hz) of exciting circuit 27

μ: magnetic permeability

ρ: specific resistivity.

Figure 9:
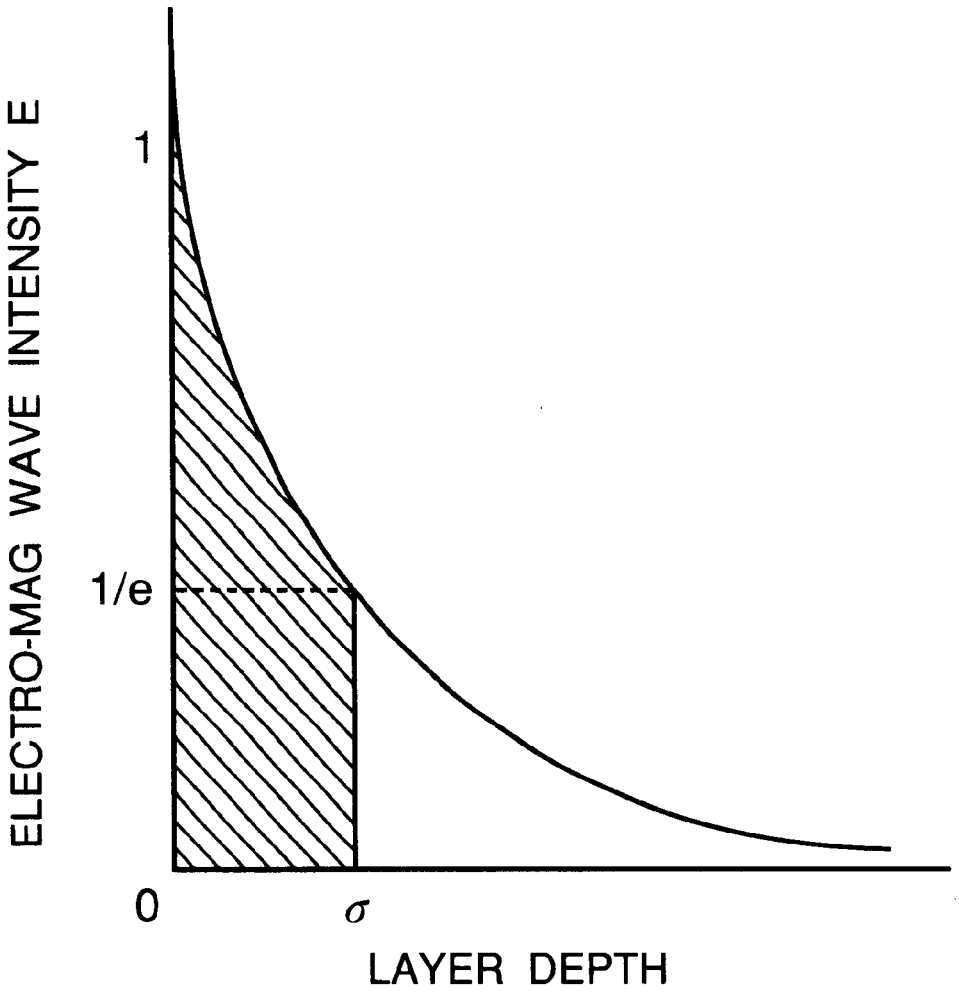
FIG. 9 is a graph for showing a relationship between a thickness of the heat generating layer and a strength of the electromagnetic wave.

This shows the depth level to which the electromagnetic wave used for electromagnetic induction reaches. At a point deeper than the depth level obtained by the above equation, the strength of the electromagnetic wave is no more than 1/e. Reversely stated, most of the energy of the magnetic wave is absorbed before the magnetic wave reaches this depth level (FIG. 9).

The thickness of the heat generating layer 1 is desired to be 1–100 μm, preferably, 20–100 μm. If the thickness of the heat generating layer 1 is smaller than 1 μm, most of the electromagnetic energy fails to be absorbed by the heat generating layer 1; efficiency is low. Further, from the standpoint of mechanical strength, the thickness of the heat generating layer 1 is desired to be no less than 20 μm.

On the other hand, if the thickness of the heat generating layer 1 exceeds 100 μm, the heat generating layer 1 becomes too rigid, in other words, inferior in flexibility, which makes it impractical for the heat generating layer 1 to be a part of the flexible rotational member. Thus, the thickness of the heat generating layer 1 is desired to be 1–100 μm, preferably, in a range of 20–100 μm, in consideration of the mechanical strength. In this embodiment, 50 μm thick nickel film formed by electroplating was used as the material for the heat generating layer 1.

b. Elastic Layer 2

The material for the elastic layer 2 is such substances as silicone rubber, fluorinated rubber, fluoro-silicone rubber, and the like, that are superior in heat resistance and thermal conductivity.

The elastic layer 2 is important for preventing minute mosaic defects from being formed in an image during fixation. In other words, with the provision of the elastic layer 2, the release layer 3, that is, the surface layer, of the sleeve 10 is enabled to press on the toner particles on the transfer medium P, in the least disturbing manner, preventing the sleeve 10 from causing anomalies in an image during fixation.

Thus, in terms of the hardness in JIS-A, in other words, the hardness measured with the use of an A-type hardness gauge (JIS-K6301), it is necessary for the material (rubber) for the elastic layer 2 to be no more than 30 degrees, preferably, no more than 25 degrees. As for the thickness, it is necessary for the elastic layer 2 to be no less than 50 μm, preferably, no less than 100 μm.

If the thickness of the elastic layer 2 exceeds 500 μm, the elastic layer 2 becomes excessive in thermal resistance, making it difficult to give the fixing apparatus "quick start" capability (almost impossible if the thickness is no less than 1,000 μm). Thus, the thickness of the elastic layer 2 is desired to be no more than 500 μm.

The thermal conductivity λ of the elastic layer 2 is desired to be in a range of $2.5\times10^{-1}$–$8.4\times10^{-1}$ [W/m/° C.] ($6\times10^{-4}$–$2\times10^{-3}$ [cal/cm.sec.deg]).

If the thermal conductivity λ is smaller than $2.5\times10^{-1}$ [W/m/° C.] the thermal resistance of the elastic layer 2 is excessively large, delaying the temperature increase of the surface layer (release layer 3) of the sleeve 10.

On the other hand, if the thermal conductivity λ is no less than $8.4\times10^{-1}$ [W/m/° C.], the elastic layer 2 becomes excessively hard, and/or the compression set of the elastic layer 2 worsens.

Thus, the thermal conductivity λ is desired to be in the range of $2.5\times10^{-1}$–$8.4\times10^{-1}$ [W/m/° C.], preferably, $3.3\times10^{-1}$–$6.3\times10^{-1}$ [W/m/° C.] ($8\times10^{-4}$–$1.5\times10^{-3}$ [cal/cm.sec.deg]).

In this embodiment, silicone rubber which was 10 degree in hardness (JIS-A), and $4.2\times10^{-1}$ [W/m/° C.] ($1\times10^{-3}$ [cal/cm.sec.deg]) in thermal conductivity, was used to form the elastic layer 2 with a thickness of 300 μm.

c. Release Layer 3

As the material for the release layer 3, it is possible to select a substance superior in releasing ability and heat resistance, for example, fluorinated resin, silicone resin, fluoro-silicone resin, fluorinated rubber, silicone rubber, PFA, PTFE, FEP, or the like. The release layer 3 can be formed of one of these fluorinated resins, in the form of a piece of tube, or can be formed by coating (painting) one of these materials directly on the elastic layer 2.

In order to satisfactorily conduct the softness of the elastic layer 2 to the surface of the sleeve 10, the thickness of the release layer 3 must be no more than 100 μm, preferably, no more than 80 μm. If the thickness of the release layer 3 is greater than 100 μm, the sleeve 10 fails to press on the toner particles on the transfer medium P in the least disturbing manner, resulting in the formation of an image having anomalies across its solid areas.

Further, the thinner the elastic layer 2, the smaller the maximum value for the thickness of the release layer 3 must be. According to the results of the studies carried out by the applicants of the present invention, the thickness of the release layer 3 needed to be no more than ⅓ of the thickness of elastic layer 2; when it was more, the softness of the elastic layer 2 could not satisfactorily be reflected by the surface of the sleeve 10.

On the other hand, if the thickness of the release layer 3 is under 5 μm, the mechanical stress to which the elastic layer 2 is subjected cannot be cushioned by the release layer 3, which causes the elastic layer and/or release layer themselves to deteriorate. Thus, the thickness of the release layer 3 needs to be no less than 5 μm, preferably, no less than 10 μm.

In this embodiment, a piece of PFA tube with a thickness of 30 μm was used as the release layer 3.

To summarize the relationship between the thicknesses of the elastic layer 2 and release layer 3, it is desired that there is the following relationship between the thickness of the elastic layer 2 and release layer 3:

$$50\ \mu m \leqq t1 \leqq 500\ \mu m$$

$$5\ \mu m \leqq t2 \leqq 100\ \mu m,$$

and $$t1 \geqq 3 \times t2$$

t1: thickness of elastic layer 2 t2: thickness of release layer 3.

d. Heat Insulating Layer 4

Regarding the structure of the sleeve 10, the sleeve 10 may be provided with a heat insulating layer 4, which is layered on the sleeve guiding member side (side opposite to where elastic layer 2 is layered) of the heat generating layer 1, as shown in FIG. 8(*b*).

As for the material for the heat insulating layer 4, heat resistant substance is desirable: for example, fluorinated resin, polyimide resin, polyamide resin, polyamide-imide resin, PEEK resin, PES resin, PPS resin, PFA resin, PTFE resin, or FEP resin.

The thickness of the heat insulating layer 4 is desired to be 10–1,000 μm. If it is no more than 10 μm, the heat insulating layer 4 is not effective as a heat insulating layer, and also, lacks durability. On the other hand, if the thickness of the heat insulating layer 4 exceeds 1,000 μm, a mechanical rigidity of the heat insulating layer 4 is increased, the sleeve 10 is less liable to be deformed in a circumferential direction. Further, the distances from the magnetic cores 17*a,* 17*b,* and 17*c,* to the heat generating layer 1, and the distance from the exciting coil 18 to the heat generating layer 1 become too large for a sufficient amount of the magnetic flux to be absorbed by the heat generating layer 1.

With the provision of the heat insulating layer 4, the heat generated in the heat generating layer 1 is prevented from conducting inward of the sleeve 10. Therefore, the heat generated in heat generating layer 1 is conducted to the transfer medium P at a ratio higher than without the heat insulating layer 4, reducing thereby power consumption.

In this embodiment, the heat insulating layer 4 is formed of a ca. 30 μm-thick polyimide resin film.

D) Dimensional Relationship in Longitudinal Direction

Figure 10:
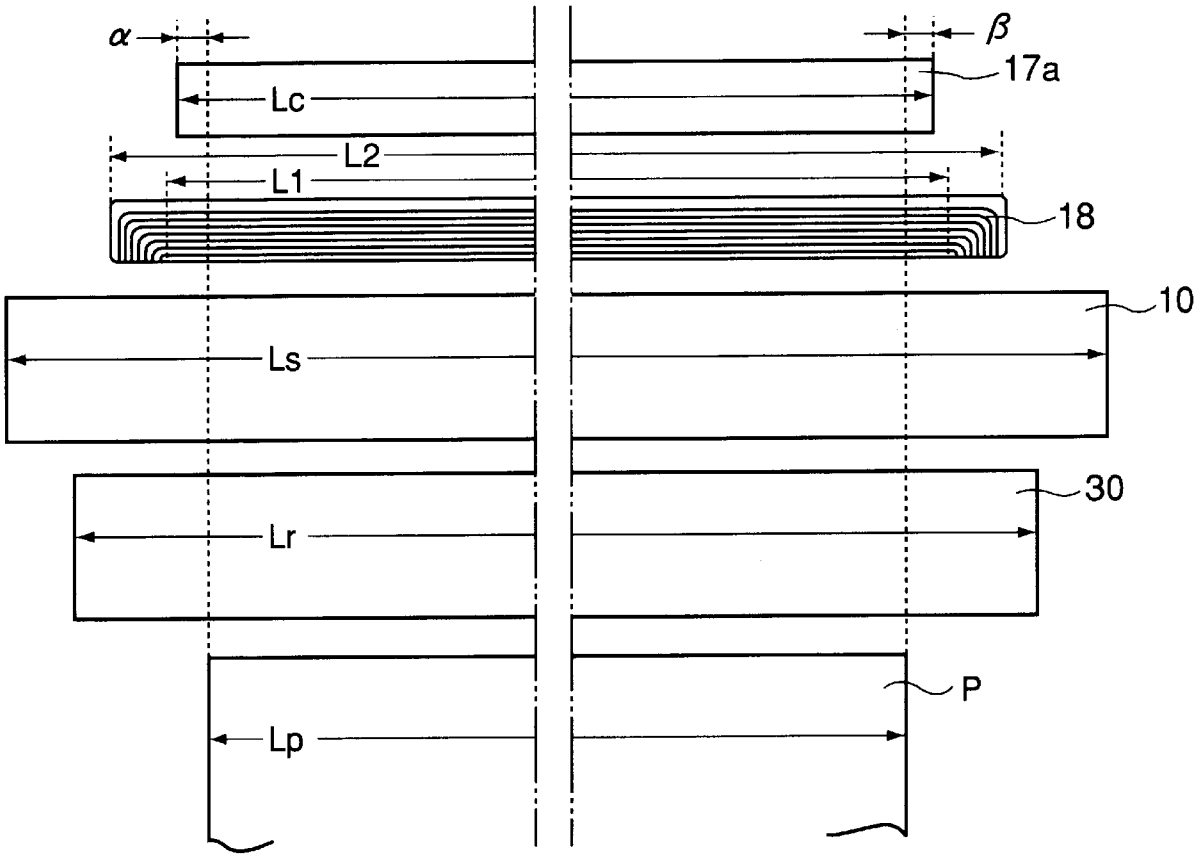
FIG. 10 is a schematic sectional view for showing a dimensional relationship in longitudinal direction among respective structural members of the image heating apparatus of the present invention.

FIG. 10 shows a dimensional relationship among the respective structural members constituting the fixing apparatus in their longitudinal directions.

Referring to FIG. 10, the magnetic core 17*a* (perpendicular to the coil 18) has a (maximum) longitudinal direction Lc; the exciting coil 18 has a minimum longitudinal length (i.e., that of the exciting coil 18 closest to the magnetic core 17*a*) L1 and a maximum longitudinal length (i.e., that of the exciting coil 18 farthest from the magnetic core 17*a*) L2; the sleeve 10 has a longitudinal length Ls; the pressure roller 30 has a longitudinal length L2; and the transfer medium P has a width Lp.

Further, the longitudinal length Lc of the magnetic core 17*a* is designed to be longer than the width Lp of the transfer medium P by α+β (α=β).

Figure 12:
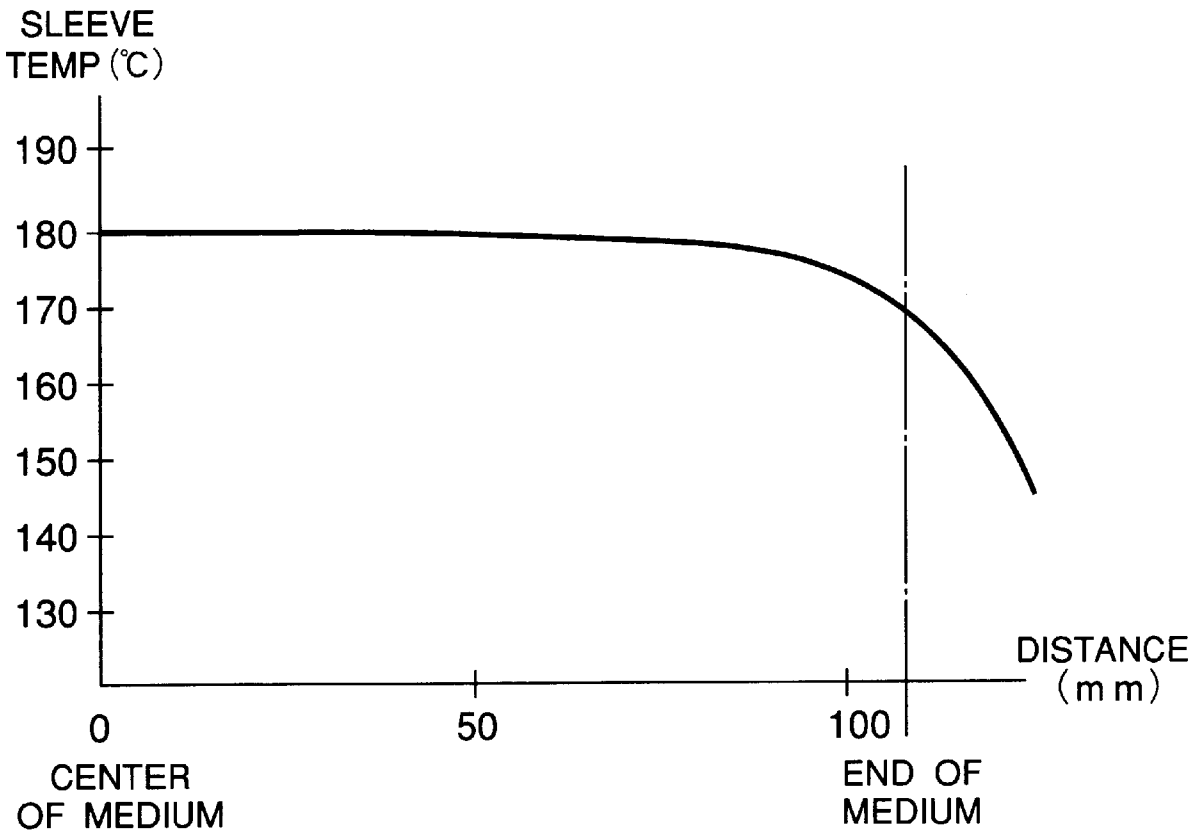
FIG. 12 is a graph for showing a state such that a temperature of the sleeve surface is lowered at an end portion of a transfer medium.

This is because a magnetic flux C (which is changed in direction in accordance with a direction of the alternating electric field applied to the exciting coil 18 and the arrow direction is inverted with time) becomes sparse at a longitudinal end of the coil, thus lowering an amount of heat generation of the sleeve 10 and because heat is escaped from a longitudinal end of the sleeve 10 by heat dissipation therefrom, thus resulting in a lowering in surface temperature of the sleeve 10 at its longitudinal end, as shown in FIG. 12.

Figure 11:
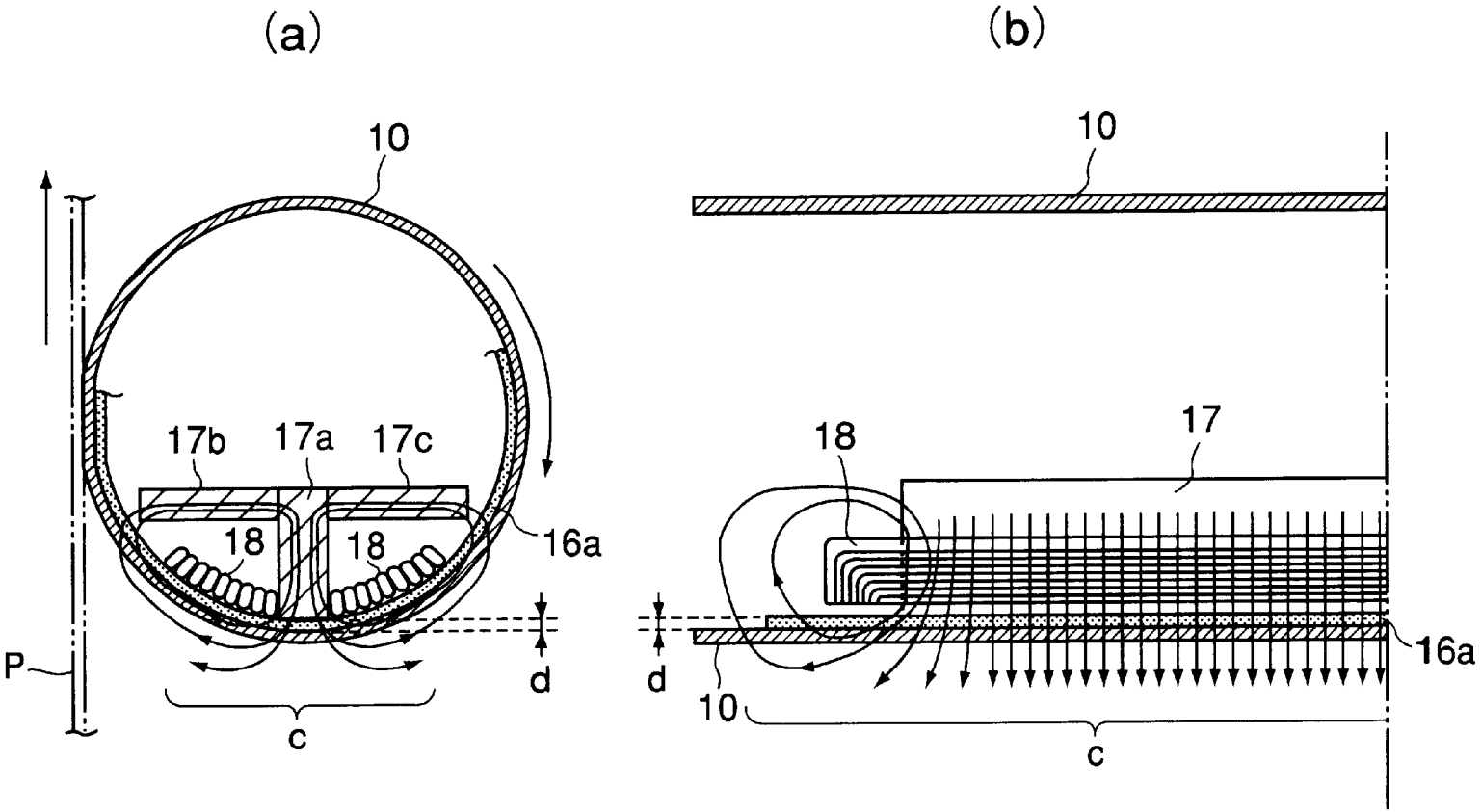
FIG. 11 includes schematic views showing a shape of magnetic field acting on a cross section of the sleeve (at (a)) and the front side of the sleeve (at (b)) where magnetic fluxes act on the sleeve in an oblique direction at an end portion of a core of the magnetic field generating means.

FIG. 11 shows at (a) a schematic sectional view of the sleeve 10 when the magnetic flux C is viewed from a cross-sectional direction of the sleeve 10 and at (b) a schematic sectional view of the sleeve 10 when the magnetic flux C is viewed from a recording medium conveying direction.

FIG. 12 shows an example of heat distribution at the surface of the sleeve 10 in the case where the gap d (FIG. 2) is set to 1 mm and the longitudinal length Lc of the magnetic core 17*a* is set to 222 mm.

In this embodiment, the sleeve 10 contacts a rib 16*e* (FIG. 5) of the sleeve guiding member (holder) 16*a* during not only a stop period but also a rotation period, the gap d is designed to have a value determined by adding a thickness of the heat insulating layer 4 of the sleeve to a thickness of the sleeve guiding member (holder) 16*a* (including a height of the rib 16*e*. However, in the case where the sleeve 10 is designed to be detached from the holder 16*a* at the position of the core 17*a* during the stop period or the rotation period, the gap d is determined by also taking into consideration a distance between the sleeve 10 and the holder 16*a*. Accordingly, the gap d referred to herein means a maximum distance between the core and the heat generating layer during the stop period and the rotation period.

According to study of the inventors of the present application, it has been confirmed that a degree of lowering in surface temperature at the end portion of the sleeve depends on the distance (gap) d between the core 17*a* and the sleeve 10 (exactly between the core 17*a* and the (metallic) heat generating portion of the sleeve 10).

More specifically, the relationship between the distance d and the degree of surface temperature lowering is shown in Table 1.

TABLE 1

| d (mm) | 1 | 2 | 3 |
|---|---|---|---|
| ΔT (deg.) | 12 | 15 | 20 |
| α (= β) (mm) | 3 | 5 | 7 |

In Table 1, T (deg.) represents a degree of lowering in surface temperature of the sleeve 10 at the end portion of the transfer medium on the basis of a surface temperature at the central portion of the sleeve 10 when the gap d is set to 1 mm, 2 mm and 3 mm, respectively. Further, α(=β) (mm) (FIG. 10) represents an extended length in the longitudinal length Lc of the magnetic core 17*a* (on the basis of the longitudinal length Lp of the transfer medium P) in the case of providing the sleeve surface with a minimum temperature required to allow fixation at a position corresponding to the end portion of the transfer medium.

In this embodiment, when the sleeve surface temperature at the central portion is 180° C., a lower-limit acceptable temperature at the end portion is set to 170° C.

For the above-described reason, in consideration of loss of heat due to a curve in magnetic flux C at the end portion and an occurrence of temperature lowering due to heat dissipation at the sleeve and portion, the gap d (mm) and the extended length α(=β) (mm) are expected to approximately satisfy the following relationship:

$$\alpha=\beta \geqq Ad+B(A,\ B\text{: constant}) \quad (1)$$

In practice, it has been empirically found from the results shown in Table 1 that the following relationship is satisfied.

$$\alpha=\beta \geqq 2d+1 \quad (2)$$

Incidentally, when the magnetic core 17*a* is extended, the longitudinal lengths L1 and L2 of the exciting coil 18 are also required to be extended. In other words, the following relationship is satisfied.

$$Lc \leqq L1 < L2 \quad (3)$$

Further, a heating region ranges over a non-feeding region of paper (transfer medium) in a longitudinal direction, so that it is necessary to forcedly draw heat from the non-feeding region of paper of the sleeve 10 where heat is not drawn from the sleeve 10 by the transfer medium, in order to prevent temperature rise. For this reason, in the present invention, the pressure roller 30 is extended in its longitudinal direction, thereby lowering the surface temperature of the sleeve 10 in the non-feeding region of paper. More specifically, the longitudinal lengths Lc, Lr and Ls are set to satisfy the following relationship:

$$Lc \leqq Lr < Ls \quad (4)$$

Further, the following equation is satisfied.

$$LC = Lp + \alpha + + \beta \quad (5)$$

From the relationships (2), (3) and (5), the following relationships are derived.

$$\alpha + \beta \geqq 2(2d+1)$$

$$LC = Lp + \alpha + \beta \geqq Lp + 2(2d+1)$$

Accordingly, the following relationship is consequently derived.

$$LP + 2(2d+1) \leqq L1 < L2 \quad (6)$$

More specifically, in this embodiment, dimensional parameters for respective structural members are set as follows so as to satisfy the above-mentioned relationships (4) an (6) in the case where letter-size paper is fed in its longitudinal direction.

Lp (transfer medium width)=216 mm, d (gap between the magnetic core 17*a* and the (heating layer of) sleeve 10)=2 mm, Lc (longitudinal length of the magnetic core 17*a*) =238 mm, L1 (inner length of the coil 18)=244 mm, L2 (outer length of the coil 18)=270 mm, Lr (longitudinal length of the pressure roller 30)=250 mm, Ls (longitudinal length of the fixing sleeve 10)=284 mm.

As a result, even when a continuous printing test on 1000 sheets of paper was performed, good results free from fixation failure at end portions, temperature rise at non-feeding region of paper, etc., were attained.

Incidentally, the longitudinal length Lr of the pressure roller 30 and the outer (maximum) length L2 of the coil 18 are set to satisfy: Lr<L2, but may be set to satisfy: Lr>L2 since a heating region in longitudinal direction largely affect the length of the core rather than the length of the coil.

However, the coil temperature is also increased by energization, so that the relationship between the longitudinal length Ls of the fixing sleeve 10 and the outer length L2 of the coil 18 may preferably be as follows so as not to waste an amount of heat dissipation by energization.

$$L2 \leqq Ls \quad (7)$$

According to study of the inventors of the present application, in the case of L2 >L3, a degree of escape of heat from the end portion of the exciting coil 18 was increased, thus undesirably lowering remarkably a heating efficiency of the sleeve 10.

Incidentally, the longitudinal lengths of the magnetic cores 17*b* and 17*c* are not strictly influential when compared with the case of the magnetic core 17*a*. However, in order to prevent escape of magnetic force toward the outside, longitudinal width of the magnetic cores 17*b* and 17*c* may desirably be set to be equal to or larger than that of the magnetic core 17. Further, in this embodiment, the magnetic core 17*a* is designed to be disposed between the magnetic cores 17*b* and 17*c*. However, the magnetic cores 17*b* and 17*c* may be integrally formed into a single magnetic core and disposed on the magnetic core 17*a* to constitute a T-shaped magnetic core (in cross section).

Embodiment 2

In Embodiment 1 described above, the longitudinal length (width) Lr of the pressure roller 30 is set to satisfy: Lr>Lc.

In place of this arrangement, a cooling member may be disposed so as to contact the sleeve 10 at the non-feeding region of paper of the sleeve 10.

Figure 13:
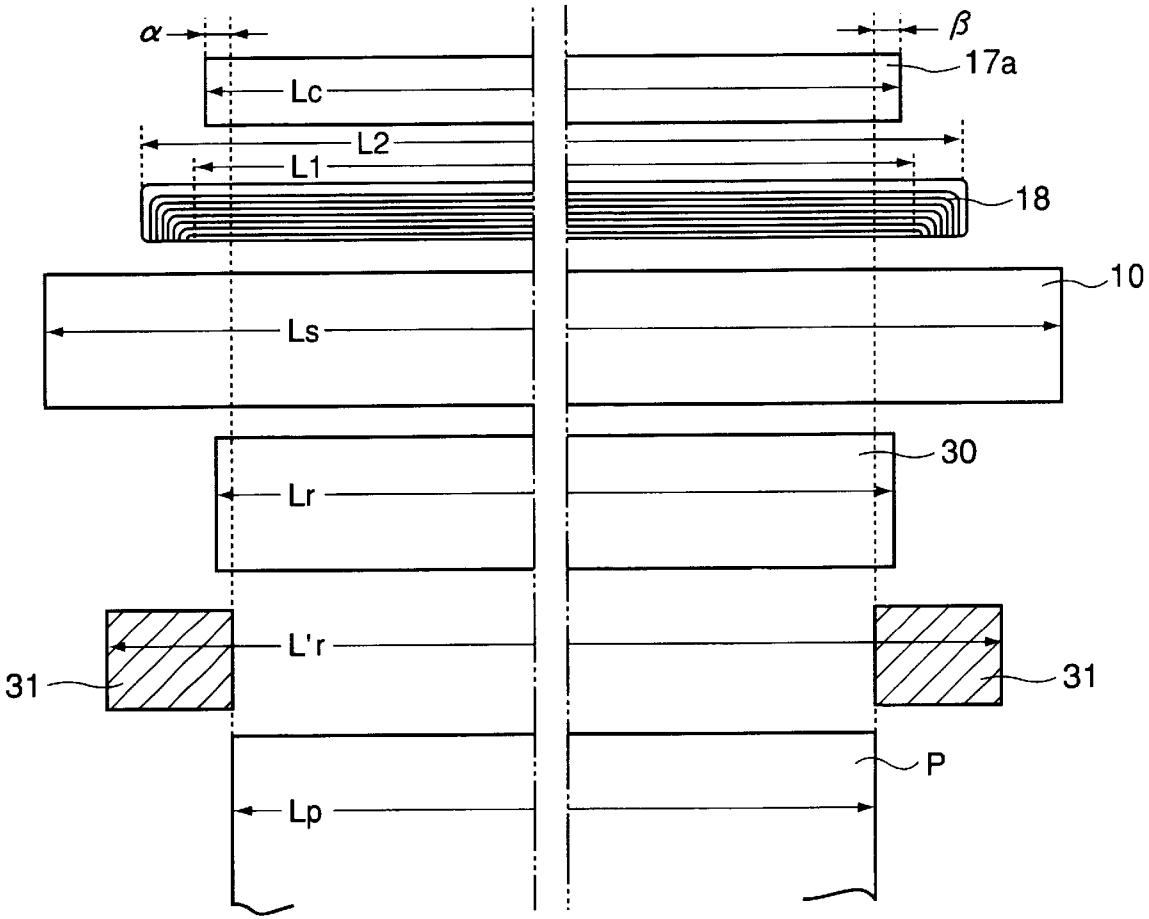
FIG. 13 is a schematic sectional view for showing a dimensional relationship in longitudinal direction along respective structural members of the image heating apparatus including a cooling roller 31 used in Embodiment 2.
Figure 14:
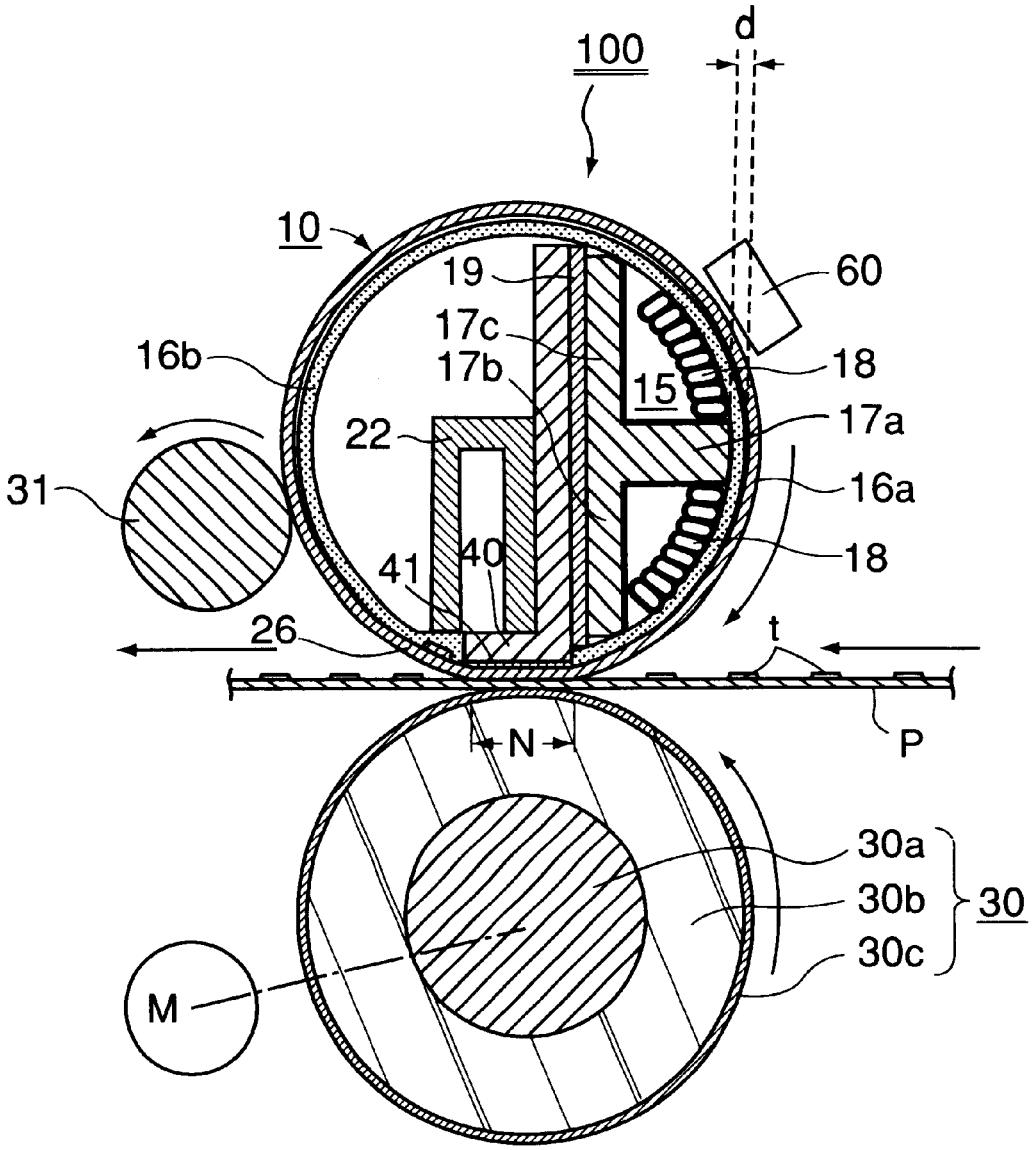
FIG. 14 is a schematic sectional view of the essential portion of the image heating apparatus shown in FIG. 13.

More specifically, in this embodiment, as shown in FIGS. 13 and 14, metallic rollers 31 are disposed so that they are rotated mating with the sleeve 10 at the non-feeding region of paper of the sleeve 10, thus suppressing temperature rise at the non-feeding region of paper. The metallic rollers 31 are disposed so as to overlap the two end portions of the pressure roller 30 while setting a maximum distance L'r between the two metallic rollers 31 so a to satisfy: L'r>Lc.

In anther embodiment, rollers 32 formed of metal, resin, rubber, etc., are coaxially disposed with the pressure roller 30 so that a maximum distance L'r between the two rollers 32 satisfies: L'r>Lc, as shown in FIG. 15.

By arranging the rollers 31 or 32 as described above, it is possible to use a roller of a material having a larger heat capacity than the pressure roller 30, thus further effectively suppressing temperature rise at the non-feeding region of paper of the sleeve 10.

Figure 15:
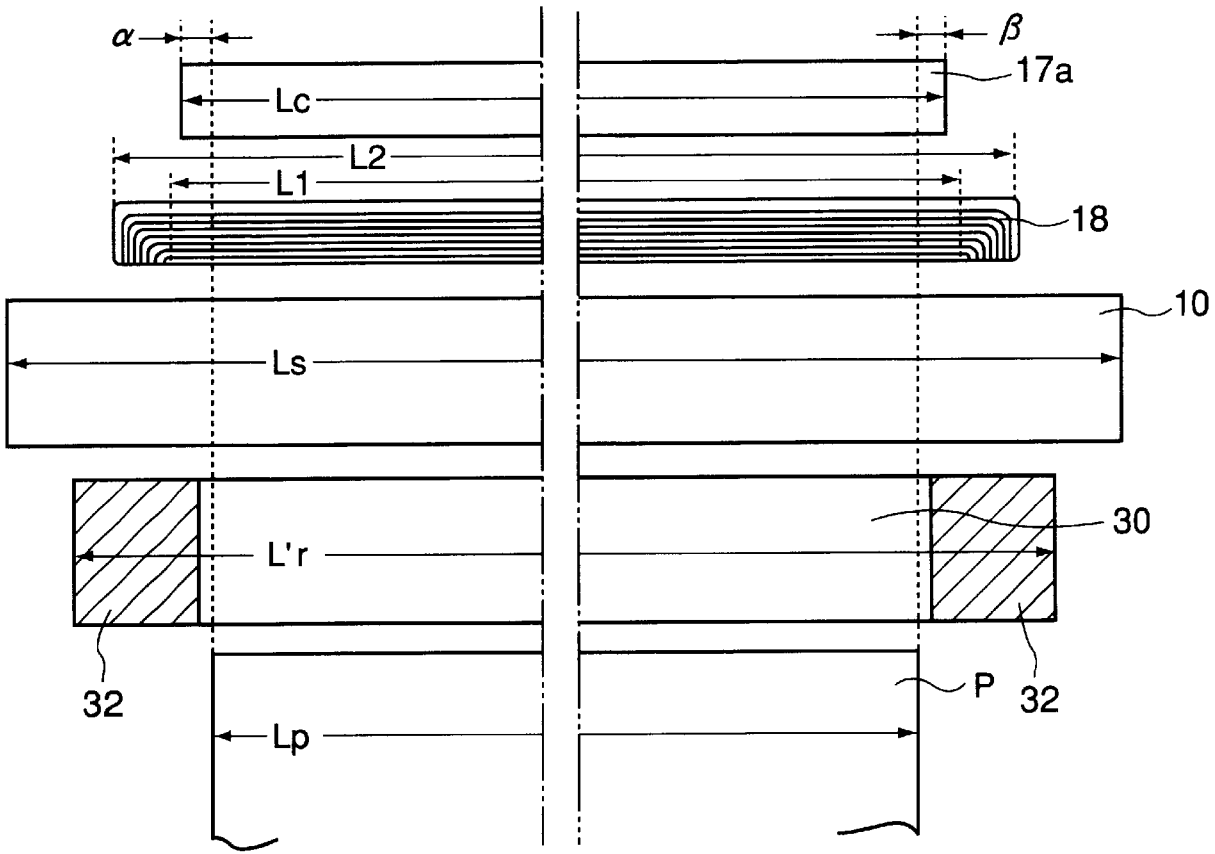
FIG. 15 is a schematic sectional view for showing a dimensional relationship in longitudinal direction along respective structural members of the image heating apparatus in another embodiment.

In the embodiment shown in FIG. 15, in view of deformation of the pressure roller 30 at the nip portion, the rollers 32 needs to be slightly smaller in diameter than that of the pressure roller 30 or formed of a material having a hardness substantially equal to that of the pressure roller 30.

The arrangement in this embodiment may also be employed a an auxiliary means for Embodiment 1. In this case, the dimensional relationship in FIG. 13 may b changed to satisfy: Lr>Lc and L'r>Lc.

In other embodiments, the fixing film (sleeve) 10 having an electromagnetic induction heating property may be formed in layer structure free from the elastic layer 2 in the case where the fixing film 10 is used for heat fixation of monochromatic color image or one-pass multi-color image. Further, the heating layer 1 may be formed of a resin and a metallic filler contained in the resin. Further, the fixing film 10 may be formed of a single layer consisting of a heating layer.

The image heating apparatus of the present invention may be applicable for various purposes other than the above-mentioned image fixation purpose. Specifically, the image heating apparatus may be widely used as means for heat-heating a member to be heated, e.g., for modifying surface properties, such as gloss by heating a recording (transfer) medium carrying thereon an image; for pre-fixation; for drying by heating; and for heat laminating.

While the invention has been described with reference to the structures disclosed herein, it is not confined to the details set forth and this application is intended to cover such modifications or changes as may come within the purposes of the improvements or the scope of the following claims.

What is claimed is:

1. An image heating apparatus for heating an image formed on a recording material, comprising:

a heating member having a heat-generating layer, and magnetic field-generating means for generating a magnetic field to induce an eddy current in said heat-generating layer, said magnetic field-generating means comprising a core and a coil disposed around said core in a longitudinal direction of said core;

wherein said coil has a minimum length L1 and a maximum length L2 respectively in a longitudinal direction thereof; said core has a maximum length Lc in the longitudinal direction thereof; said core and said heating layer form a gap d therebetween; and the recording material has a prescribed maximum size giving a passing width Lp, satisfying the following relationship:

$$Lp+2(2d+1)\leqq Lc\leqq L1<L2.$$

2. An apparatus according to claim 1, further comprising a backup member contacting said heating member, wherein said heating layer has a length Ls in a longitudinal direction thereof, and said backup member has a length Lr in a longitudinal direction, satisfying the following relationship:

$$Lc\leqq Lr<Ls.$$

3. An apparatus according to claim 1, wherein L2 and Ls satisfy the following relationship:

$$L2<Ls.$$

4. An apparatus according to claim 1, wherein said heating member has a sliding layer on said magnetic field-generating means side of said heating layer.

5. An apparatus according to claim 1, wherein said heating member is flexible and in a sleeve shape.

6. An apparatus according to claim 1, further comprising a holder for holding said core disposed between said core and said heating member.

7. An apparatus according to claim 6, wherein said holder also holds said coil.

8. An apparatus according to claim 1, wherein said heating member is in a sleeve shape, and said coil is in a shape such that a portion thereof parallel to its longitudinal direction is disposed along an inner shape of said heating member.

* * * * *

UNITED STATES PATENT AND TRADEMARK OFFICE

CERTIFICATE OF CORRECTION

PATENT NO. : 6,704,537 B2
DATED : March 9, 2004
INVENTOR(S) : Akihiko Takeuchi et al.

It is certified that error appears in the above-identified patent and that said Letters Patent is hereby corrected as shown below:

Column 3,
Line 45, “passes.” should read -- pass. --.

Column 8,
Line 49, “layer,” should read -- later, --.

Column 14,
Line 23, “degree” should read -- degrees --.

Column 15,
Line 57, “is” should read -- has -- .

Column 16,
Line 11, “16e.” should read -- 16e). --.
Line 34, “T(deg.)” should read -- ΔT (deg.) --.
Line 51, “and” (1st occurrence) should read -- end --.

Column 17,
Line 14, “LC=Lp+α++β” should read -- Lc = Lp+α+β --.
Line 20, “LC=Lp+α+β≧Lp+2(2d+1)” should read -- Lc=Lp+α+β≧Lp+2(2d+1) --.
Line 25, “LP+2(2d+1)≦L1<L2” should read -- Lp+2(2d+1)≦L1<L2 --.
Line 30, “(4) an (6)” should read -- (4) and (6) -- .
Line 49, “affect” should read -- affects --.

Column 18,
Line 3, “magnetic core 17.” should read -- magnetic core 17a. --.
Line 42, “a an” should read -- as an --.

UNITED STATES PATENT AND TRADEMARK OFFICE

CERTIFICATE OF CORRECTION

PATENT NO. : 6,704,537 B2
DATED : March 9, 2004
INVENTOR(S) : Akihiko Takeuchi et al.

It is certified that error appears in the above-identified patent and that said Letters Patent is hereby corrected as shown below:

Column 18 (cont),
Line 43, "may be" should read -- may be --.

Signed and Sealed this

Sixth Day of July, 2004

JON W. DUDAS
*Acting Director of the United States Patent and Trademark Office*